US009021634B2

(12) United States Patent
Goto et al.

(10) Patent No.: US 9,021,634 B2
(45) Date of Patent: May 5, 2015

(54) SIX-WHEELED STRETCHER

(71) Applicants: Kazuyuki Goto, Gifu (JP); Noriyuki Matunaga, Gifu (JP); Shigeyuki Matunaga, Gifu (JP)

(72) Inventors: Kazuyuki Goto, Gifu (JP); Noriyuki Matunaga, Gifu (JP); Shigeyuki Matunaga, Gifu (JP)

(73) Assignee: Matunaga Manufacturing Co., Ltd., Yoru-Gun (JP)

( * ) Notice: Subject to any disclaimer, the term of this patent is extended or adjusted under 35 U.S.C. 154(b) by 0 days.

(21) Appl. No.: 14/136,279

(22) Filed: Dec. 20, 2013

(65) Prior Publication Data

US 2014/0103677 A1 Apr. 17, 2014

Related U.S. Application Data

(63) Continuation of application No. 13/102,030, filed on May 5, 2011, now abandoned, and a continuation of application No. PCT/JP2009/068450, filed on Oct. 28, 2009.

(30) Foreign Application Priority Data

| | | |
|---|---|---|
| Nov. 7, 2008 | (JP) | 2008-286352 |
| Dec. 22, 2008 | (JP) | 2008-325099 |
| Jun. 16, 2009 | (JP) | 2009-142934 |

(51) Int. Cl.

| | |
|---|---|
| ***A61G 1/02*** | (2006.01) |
| ***A61G 1/048*** | (2006.01) |
| ***A61G 1/056*** | (2006.01) |
| *A61G 7/05* | (2006.01) |

(52) U.S. Cl.

CPC ..... *A61G 1/0218* (2013.01); *A61G 1/048* (2013.01); *A61G 1/0562* (2013.01); *A61G 2007/051* (2013.01); *A61G 1/0237* (2013.01); *A61G 1/0262* (2013.01); *A61G 1/0212* (2013.01); *A61G 1/0256* (2013.01); *A61G 1/0287* (2013.01); *A61G 1/0293* (2013.01)

(58) Field of Classification Search

CPC . A61G 1/0212; A61G 1/0218; A61G 1/0237; A61G 1/0256; A61G 1/0262; A61G 1/0287; A61G 1/0562

USPC ..... 5/86.1, 625, 627, 510

See application file for complete search history.

(56) References Cited

U.S. PATENT DOCUMENTS

| | | | | |
|---|---|---|---|---|
| 4,037,291 | A * | 7/1977 | Huempfner et al. | 16/35 R |
| 4,759,098 | A * | 7/1988 | Ko | 16/29 |
| 5,015,024 | A * | 5/1991 | Bloemer | 296/20 |
| 5,509,159 | A * | 4/1996 | Du-Bois | 5/627 |
| 6,321,878 | B1 * | 11/2001 | Mobley et al. | 188/1.12 |

(Continued)

*Primary Examiner* — Robert G Santos
*Assistant Examiner* — Ifeolu Adeboyejo
(74) *Attorney, Agent, or Firm* — Shumaker, Loop & Kendrick, LLP

(57) ABSTRACT

A stretcher including an upper frame for mounting a lifter thereon, a front leg pivotably attached to the upper frame, a rear leg pivotably attached to the upper frame, a fixed caster attached to one end of the front leg, a swivel caster attached to one end of the rear leg, and an auxiliary swivel caster attached to the front leg, wherein the upper frame is vertically adjustable by folding the front and rear legs relative to the upper frame, and wherein the auxiliary swivel caster is positioned relative to the fixed caster such that the auxiliary swivel caster is in contact with the ground when the upper frame is fully lowered and the front leg is folded away from the rear leg, and the auxiliary swivel caster is out of contact with the ground when the upper frame is fully lowered and the front leg is folded toward the rear leg.

12 Claims, 33 Drawing Sheets

(56) References Cited

U.S. PATENT DOCUMENTS

| | | | | |
|---|---|---|---|---|
| 6,681,424 | B1 * | 1/2004 | Bourgraf et al. | 5/611 |
| 6,735,794 | B1 * | 5/2004 | Way et al. | 5/86.1 |
| 6,880,202 | B2 * | 4/2005 | Thompson et al. | 16/35 R |
| 7,200,894 | B2 * | 4/2007 | Block et al. | 16/18 R |
| 7,210,690 | B2 * | 5/2007 | Tan | 280/47.38 |
| 7,377,526 | B2 * | 5/2008 | Lan | 280/47.38 |
| 7,784,151 | B2 * | 8/2010 | Chen et al. | 16/35 R |
| 2002/0032929 | A1 * | 3/2002 | Bolden et al. | 5/689 |
| 2004/0194221 | A1 * | 10/2004 | Thompson et al. | 5/720 |
| 2005/0241064 | A1 * | 11/2005 | Lopes et al. | 5/93.1 |
| 2006/0082176 | A1 * | 4/2006 | Broadley et al. | 296/20 |
| 2006/0207027 | A1 * | 9/2006 | Matunaga et al. | 5/611 |
| 2006/0225203 | A1 * | 10/2006 | Hosoya et al. | 5/86.1 |

* cited by examiner (10A−1)

(10A−2)

(10A−3)

(10A−4)

(13B−1)

(13B−2)

SIX-WHEELED STRETCHER

CROSS-REFERENCE TO RELATED APPLICATIONS

This Continuation application claims priority to U.S. patent application Ser. No. 13/102,030 filed May 5, 2011, which is a continuation of PCT/JP2009/068450 filed Oct. 28, 2009, which claims priority to Japanese Patent Application No. 2008-286352 filed Nov. 7, 2008, Japanese Patent Application No. 2008-325099 filed Dec. 22, 2008, and Japanese Patent Application No. 2009-142934 filed Jun. 16, 2009, all of which are incorporated herein by reference.

TECHNICAL FIELD

The present invention relates to a six-wheeled stretcher mounted in an ambulance car or the like. In particular, the present invention relates to a six-wheeled stretcher mounted in an ambulance car or the like, the stretcher being provided with rotatable auxiliary casters provided above casters fixed to front legs, and when located at a position lower than an intermediate stage, being supported by the rotatable auxiliary casters and rotatable rear casters of rear legs.

BACKGROUND ART

A stretcher mounted in the ambulance car or the like must be configured to be easily mounted in and fixed to the ambulance car or the like. In emergency rescue situations, there have been proposed many improvements such as adjusting of the height of the stretcher according to emergency patients, the shape of a lifter mounted in the stretcher for transporting the emergency patient, and so on. Herein, the ambulance car or the like (hereinafter referred to as "patient-transporting vehicle") refers to a vehicle equipped with equipment for transporting the patient and the like in entering or leaving a hospital, going to a hospital, transferring to another hospital, taking to or from social welfare facilities and so on (hereinafter referred to as "stretcher"). Patent document 1 discloses a stretcher including a bed part for placing a sick or injured person, legs that are foldably provided at the bed part and are developed along with the rising of the bed part or folded with the lowering of the bed part, and wheels provided at the legs, and further including an initial lifting device for applying a lifting force to the bed part in an initial stage of a lifting operation of lifting the bed part from a position in a lowest stage to a predetermined intermediate position between the lowest stage and a highest stage.

Patent document 2 discloses a stretcher including constant force springs as slide mechanisms for vertically changing the position of an upper frame of the stretcher, mecha-lock mechanisms for stopping the upper frame of the stretcher at any position, lock mechanisms for fixing sliding of front leg auxiliary frames for assisting front legs of the stretcher, rollers for facilitating sliding between supporting parts of the front legs, the front leg auxiliary frames and rear leg auxiliary frames for assisting rear legs, and a lifter mounted in the stretcher.

Patent document 3 discloses a stretcher mounted in a vehicle comprising a truck part and a lifter part that can be engaged with the truck part, wherein the truck part includes front legs and rear legs that have base parts pivotally attached to lower front and rear parts of a base frame and front ends that can rotate forward and backward, a rolling wheel is attached to each of the front legs and the rear legs, and between the base parts of the front and rear legs and the base frame, a posture switching device for switching the posture between the state where the front legs and the rear legs each rotate forward and backward and fall from a standing state and the state where the standing state is held, and a detection device for detecting the floor surface of the vehicle and causing the posture switching device of the front legs to switch to the state where the front legs can fall backward are provided. The detection device has a back stop mechanism for bringing auxiliary wheels provided at auxiliary frames that can rotate in front of the base parts of the front legs into contact with the floor surface and maintaining the state and a motion mechanism for releasing the lock state of the posture switching device after the auxiliary wheels contacts with the floor surface and the back stop mechanism starts operation.

Although, as described above, the stretcher mounted in the ambulance car or the like has been variously improved, these improvements are not still enough. When an emergency patient is received at a low position in the stretcher with the legs being folded, brake pedals of the rotatable casters of the rear legs are located inner of the stretcher, thereby disadvantageously obstructing application of brakes. A stretcher in Patent document 4 is provided to solve this problem, and is configured to automatically apply brakes when the stretcher is set to the lowest stage. In the case of the stretcher in Patent document 4, the stretcher, when being used on a slope land or the like, can be handled in safety so as not to suddenly move even if the user forgets to brake.

Generally, in the stretcher, fixed casters are attached to the front legs and rotatable casters are attached to rear legs so that longitudinal movement can be rapidly performed in transporting the patient. In the case of using such a stretcher at an intermediate height for, for example, transferring the patient from a bed to the stretcher or transferring the patient from the stretcher to the bed, there is a problem such that the movement to lay the stretcher alongside the bed cannot be smoothly performed since the front casters are fixed. In order to perform cardiac massage in the state where a frame of the stretcher is located at a position lower than the intermediate position or to transport the stretcher at the intermediate height or lower height, it has been expected to realize the stretcher that can be smoothly moved forward and backward and left and right at the intermediate height or lower height.

Patent document 1: Japanese Unexamined Patent Application Publication No. 2005-21626

Patent document 2: WO2004/078087

Patent document 3: Japanese Unexamined Patent Application Publication No. 2003-10250

Patent document 4: Japanese Unexamined Patent Application Publication No. 2008-99952

SUMMARY OF THE INVENTION

The present invention provides a six-wheeled stretcher that can rotate forward and backward and left and right by rotatable casters even when the stretcher mounted in an ambulance car or the like is used at a position lower than an intermediate height, with its legs being folded. Further, the present invention provides a six-wheeled stretcher that can be used in safety without moving even when it is used at the lowest position in an uneven place, because brakes are applied on rotatable rear leg casters when the legs are completely folded, thereby fixing the rear casters.

Means for Solving the Problems

As a result of close examination to solve the above-mentioned problems, a stretcher mounted in a patient-transporting vehicle has an upper frame for mounting a lifter thereon, and front legs and four rear legs that are axially attached to the upper frame, wherein the rear legs are rear main legs and rear auxiliary legs. Further, upper ends of the rear auxiliary legs are mounted to both ends of the upper frame; rotatable auxiliary casters are attached to casters fixed to the front legs and above the fixed casters; rotatable casters are attached to the rear legs; and link operation parts are axially attached to front ends of support arms for supporting the rotatable casters attached to the rear legs. The rotatable casters and one ends of the rear leg are axially attached to the link operation parts, respectively, and the rear auxiliary legs are axially attached to rear ends of the support arms, respectively. When the rear legs and the rear auxiliary legs hold axes of the casters vertically to set the stretcher to the intermediate position, the rotatable auxiliary casters contact the ground, and together with the rotatable rear casters, make the six-wheeled stretcher movable forward and backward and left and right.

According to a feature of the present invention, a six-wheeled stretcher mounted in a patient-transporting vehicle includes an upper frame for mounting a lifter thereon; front legs and rear legs that have upper ends axially attached to the upper frame: and a slide mechanism for assisting vertical movement of the position of the upper frame. In the stretcher, front leg fixed casters and rear auxiliary legs having upper ends mounted to the upper frame is attached to lower ends of the front legs, one ends of support arms for vertically holding axes of rotatable casters are axially attached to lower ends of the rear auxiliary legs, the other ends of the support arms are axially attached to rear parts of the link operation parts of the rotatable casters, the rotatable casters and lower ends of the rear legs are pivotally attached to front parts of the link operation parts, and the rotatable auxiliary casters are provided above the front leg fixed casters.

In a middle to rear of the six-wheeled stretcher according to the present invention, by axially attaching the rear legs and the upper ends of the rear auxiliary legs to rear leg support plates fixed to the upper frame, axially attaching the lower ends of the rear legs to rear inner sides of the link operation parts supporting the rotatable casters, axially attaching the rear auxiliary legs to one ends of the support arms and axially attaching the other ends of the support arms to front inner sides of the link operation parts, the axes of the rotatable casters can be vertically maintained at all times. When the six-wheeled stretcher according to the present invention is fixed at the intermediate stage, the six-wheeled stretcher is held by the rotatable auxiliary casters and the rotatable rear casters that are attached to the front legs and can move forward and backward and left and right.

According to another feature of the six-wheeled stretcher of the present invention, brake parts each having a brake button for fixing wheels of the casters are attached on the link operation parts from the top of the rotatable casters attached to the link operation parts of the rear legs, and when the upper frame is set to the lowest stage, the stretcher is held by the rotatable auxiliary casters of the front legs and the rotatable casters of the rear legs, and the brake buttons of the fixing brakes attached to the rotatable casters of the rear legs contact the upper frame, thereby causing the upper frame to press the brake buttons to apply brakes on the rotatable casters on the rear legs.

In the six-wheeled stretcher according to the present invention, the lower ends of the rear legs and the one ends of the support arms are axially attached to the link operation parts and the rotatable casters are attached to the bottom of the link operation parts. The brake parts for fixing wheels of the rotatable casters through the link operation parts are attached. When the upper frame of the stretcher is set to the lowest stage, the upper frame contacts the brake buttons of the fixed brake parts, thereby causing the upper frame to press the brake buttons to apply brakes on the rotatable casters. Thus, the safe six-wheeled stretcher without forgetting to brake is provided.

Further, in the six-wheeled stretcher according to the present invention, wheels of the rotatable auxiliary casters provided above the front leg fixed casters may have a size of 2 to 8 inches. However, the size of the wheels of the rotatable auxiliary casters provided above the front leg fixed casters is not limited to the above-mentioned size in consideration of easiness to emergency rescue activities performed on the six-wheeled stretcher or running stability in transporting the patient. Moreover, the size of the wheels of the rotatable auxiliary casters provided above the front leg fixed casters varies depending on size and shape of the ambulance car or the like in which the six-wheeled stretcher is mounted.

According to still another feature of the six-wheeled stretcher of the present invention, constant force springs are provided as slide mechanisms for the upper movable parts of the front legs and upper movable part of a front auxiliary frame at at least two positions.

According to still another feature of the six-wheeled stretcher of the present invention, spring members are provided as slide mechanisms for the upper movable parts of the front legs and upper movable parts of front auxiliary frames at at least two positions. By providing the spring members in place of the constant force springs, loads exerted when vertically moving the stretcher are reduced, and the strength of the loads can be easily changed by using different springs having different wire diameters, thickness and lengths.

According to still another feature of the six-wheeled stretcher of the present invention, spring covers are attached to the spring members as the slide mechanisms provided at at least two positions. The spring covers can be attached to the spring members as the slide mechanisms provided at at least two positions. As a method of attaching the spring member to the spring cover, a metal pipe may be attached to a center rail in the shape of an inverted C and the spring member may be passed through the metal pipe. Alternatively, the spring member may be directly covered with a tube made of synthetic resin to form the spring cover so that the spring member passes through the tube. A method of attaching the spring covers is not specifically limited. In the spring members, the front leg parts as well as the upper movable parts of the rear leg auxiliary frames and upper ends of the rear leg frames may be covered with the spring covers.

Although the spring covers may be metal pipe, the spring covers made of transparent synthetic resin is light-weighted and does not apply loads to the spring members, and further, the spring state can be viewed from outside, which is advantageous. The synthetic resin tubes as the spring covers may be rigid tubes or flexible soft tubes. Examples of a material for the tubes include Teflon, nylon, urethane, silicon, vinyl chloride, synthetic rubber and natural rubber. Although the tubes having resistance to cold and resistance to climate are desirable, the material for the tubes is not specifically limited.

According to still another feature of the six-wheeled stretcher of the present invention, the height of the six-wheeled stretcher in the lowest stage with a lifter that a mat is attached thereto falls within a range of 300 mm to 700 mm from a floor surface.

When the height of the six-wheeled stretcher in the lowest stage with the lifter that the mat is attached thereto falls within a range of 300 mm to 700 mm from the floor surface, operability in emergent rescue treatment for the patient such as cardiac massage and transport of the patient is improved and workloads of the ambulance crew is reduced.

According to still another feature of the six-wheeled stretcher of the present invention, a tiltable handle arm is provided at the rear of the stretcher. When the stretcher is used at a position lower than the intermediate stage, the user has to lean forward to operate the stretcher, possibly causing a lower back pain. In order to solve such a problem, the tiltable handle arm is provided at the rear of the stretcher. The handle arm can be bent and stored under a bed when unnecessary and can be raised and used to pull or push the stretcher when the stretcher is moved in the low state.

According to still another feature of the six-wheeled stretcher of the present invention, stoppers for preventing rotation of the rotatable auxiliary casters are attached above the front leg fixed casters are attached.

Effects of the Invention

The rear ends of the support arms are axially attached to the lower ends of the rear auxiliary legs, the link operation parts for supporting the rotatable casters are axially attached to front ends of the support arms, the rotatable casters and the lower ends of the rear legs are axially attached to the link operation parts and the rear auxiliary legs can vertically hold axes of the rotatable casters through the rear legs and the support arms. When the height of the six-wheeled stretcher is changed from the highest position to the intermediate position, transfer from the bed to the stretcher and from the stretcher to the bed can be rapidly achieved. At the intermediate position or the lowest position, the rotatable auxiliary casters of the front legs contact the ground and the six-wheeled stretcher rotates. Both of front wheels and rear wheels of the stretcher can rotate with a short turning radius, and therefore, reception and transport can be rapidly achieved. In addition, at the lowest position, lifesaving treatment such as cardiac massage can be easily performed and the patient can be effectively transported at a safe position.

By providing the constant force springs or tension spring members as the slide mechanisms provided to reduce loads in vertical movement of the stretcher, the constant force springs or the spring members reduce the loads generated by vertically moving the stretcher. The strength of the loads can be easily changed by using different springs having different diameters, thickness and lengths.

Further, by attaching the spring covers to the spring members, it is possible to prevent metal sound that the spring members generate when expanding or contracting. It is also possible to prevent metal sound that the spring members generate when hitting against the center rail and the like of the stretcher. Furthermore, it is possible to prevent clothes of the patient and a medical bandage from being caught by the spring members.

By providing the brake mechanisms at the rotatable rear casters, when the six-wheeled stretcher is set to the lowest position, the upper frame contacts the brake mechanisms, automatically applying brakes on the rear casters, and thus, there never occurs forgetting to brake. Further, even when the six-wheeled stretcher according to the present invention is set to the lowest position and receives the patient on the slope land, since the rotatable rear casters of the six-wheeled stretcher are automatically fixed, the operation of receiving the patient can be performed in safety.

By providing the tiltable handle arm that can be bent and stored under a bed when unnecessary at the rear of the stretcher, when the stretcher is moved in the low state after treatment such as cardiac massage, the handle arm can be raised and used to pull or push the stretcher. Further, since the stretcher can be rapidly transported in case of emergency with the handle arm being bent and pulled, loads are not applied to the lower back of the ambulance crew.

By attaching the stoppers for preventing rotation of the rotatable auxiliary casters, the stretcher can be fixed at the low position. By fixing the stretcher, advantageously, the ambulance crew can place the patient on the stable stretcher and perform temporary treatment without making the patient feel uneasy.

BRIEF DESCRIPTION OF DRAWINGS

FIG. 7B is a partial side view showing the front leg fixed caster and the 6-inch auxiliary caster in the state where the six-wheeled stretcher is mounted in the ambulance car or the like.

BEST MODE FOR CARRYING OUT THE INVENTION

Six-wheeled stretchers 100, 200, 300, 400 according to the present invention is mounted in vehicles for transporting patient or the like and when a frame (upper frame) in which a lifter is mounted is used at a position lower than an intermediate position, rotatable auxiliary casters attached to front legs contact the ground and rotate with rotatable casters of rear legs, so that the stretcher can move forward and backward and left and right.

The six-wheeled stretchers 100, 200, 300, 400 according to the present invention each are a safe six-wheeled stretcher configured without forgetting to brake so that brakes are automatically applied on the rotatable casters of the rear legs when the stretcher is set to the lowest stage. Although described below in detail with reference to figures, the six-wheeled stretchers 100, 200, 300, 400 according to the present invention may be stretchers that have a lifter and can receive and transport the emergency patient, and to which rotatable auxiliary caster are attached. However, the stretcher to which the auxiliary casters are attached is not limited to the following embodiments.

A vehicle in which the six-wheeled stretchers 100, 200, 300, 400 according to the present invention are mounted is not limited to an ambulance car and includes vehicles (patient-transporting vehicles) equipped with equipment for transporting the patient and the like in entering or leaving a medical institution, going to the medical institution, transferring to another medical institution, taking to or from social welfare facilities and so on, as well as other vehicles in which the stretcher can be mounted, such as mourning coaches.

Further, although the six-wheeled stretchers 100, 200, 300, 400 according to the present invention each have such a size that it can be mounted in the ambulance car and the like when being folded, as a matter of course, the stretchers can be used as stretchers used in hospitals and the like without being mounted in the ambulance car and the like.

Figure 1:
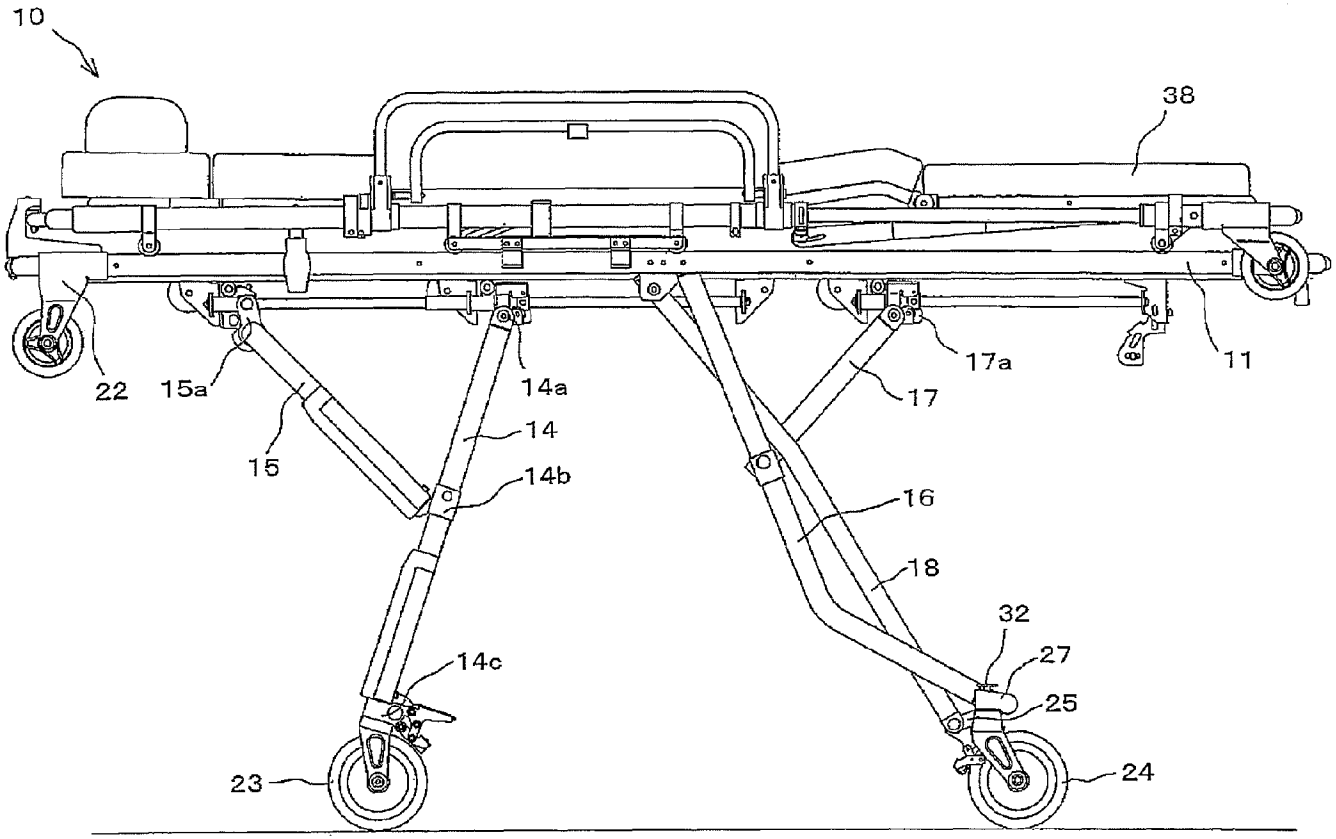
FIG. 1 is a side view of a stretcher.

The six-wheeled stretcher 100 according to the present invention is obtained by attaching the rotatable auxiliary casters above front leg fixed casters 23 shown in FIG. 1. In a stretcher 10 in FIG. 1, an upper frame 11 for mounting a lifter 38 thereon are provided and a fixed caster 22 that rotates when mounted in the ambulance car is attached to a front lower end of the upper frame 11. Slide tubes 19, 20 are horizontally provided on side surfaces of a center rail (not shown, refer to FIG. 9A) having a cross-section in the shape of an inverted C, which is provided in the upper frame 11 of the stretcher 10. Upper ends of front legs 14 and front leg auxiliary frames 15 are axially attached to the slide tube 19 via a pin lock mechanism (not shown) to be slidable. Rear leg auxiliary frames 17 are axially attached to the slide tube 20 via a pin lock mechanism (not shown, refer to FIG. 9A) to be rotatable. Rear legs 16 and rear auxiliary legs 18 are axially attached to the upper frame 11 to be rotatable. Constant force springs 26 (refer to FIG. 3 *b*) are attached to the front legs 14, the front leg auxiliary frames 15 and the rear leg auxiliary frames 17. The constant force springs reduce loads applied when the upper frame 11 on which the lifter is mounted is vertically moved.

In mounting the stretcher 100 on a frame of the ambulance car, when the stretcher 100 is pushed from the rear, the front leg auxiliary frames 15 contact the frame of the ambulance car, parts 15 *a* of the front leg auxiliary frames 15 attached to the pin lock mechanism first move backward and the front legs 14 are pushed backward from bonded parts 14 *b* of the front leg auxiliary frames 15 and then, folded. When the stretcher 10 is lowered, using 14 *b* of the front legs 14 as fulcrums, 14 *a* of the front legs 14 attached to the pin lock mechanism move backward and the front legs 14 extend forward. As to the rear legs 16, 17 *a* of the rear leg auxiliary frames 17 that is attached to the pin lock mechanism move backward, so that the stretcher 10 can be lowered.

Figure 2:
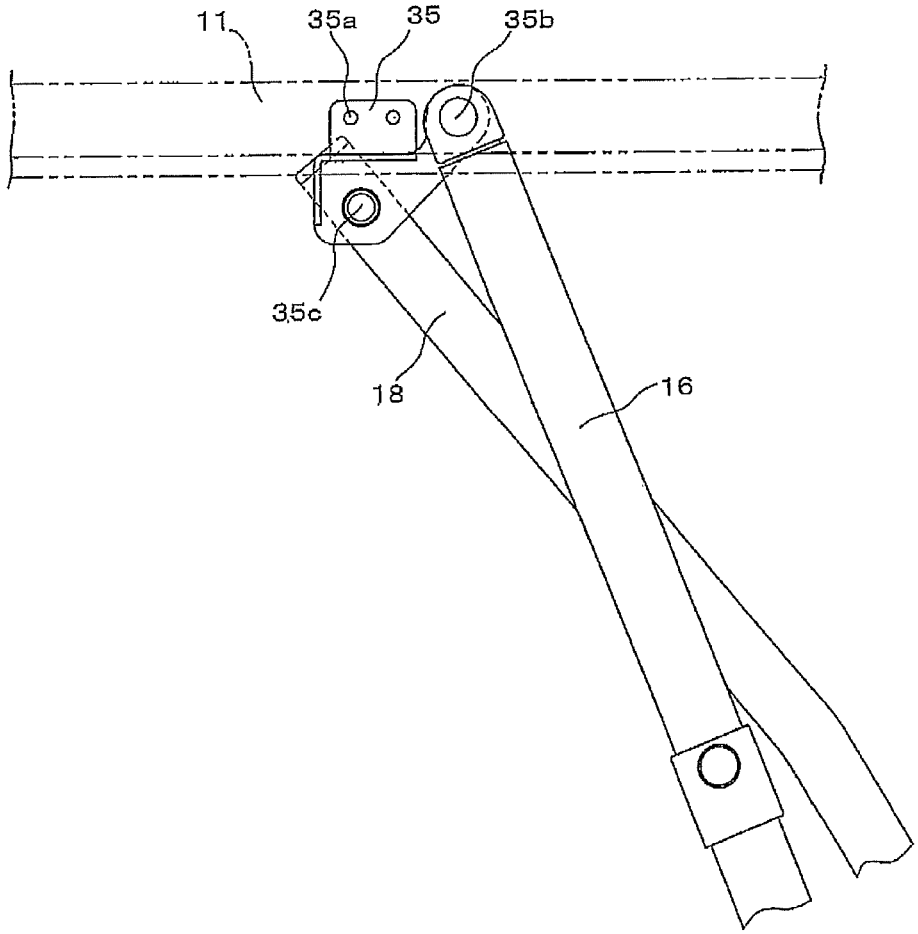
FIG. 2 is a side view showing the state where rear leg support plates to which rear legs and rear auxiliary legs are axially attached are threadedly attached to an upper frame.

As shown in FIG. 2, rear leg support plates 35 are threadedly attached to the upper frame 11. Threaded parts 35 *a* of the rear leg support plates 35 are threadedly attached to the upper frame 11 of the stretcher 10, the upper ends of the rear legs 16 are axially attached to rear leg threaded parts 35 *b* and the upper ends of the rear auxiliary legs 18 are axially attached to rear auxiliary leg threaded parts 35 *c*. The upper ends of the rear legs 16 and the rear auxiliary legs 18 are axially attached to the rear leg support plates 35 attached to the upper frame 11 and are axially moved by the rear leg auxiliary frames 17 forward and backward. In this manner, rear legs of the stretcher are composed of four legs: the rear legs 16 and the rear auxiliary legs 18, upper ends of which are attached to the upper frame 11. In both of the case where the stretcher 10 is mounted in the ambulance car and where the stretcher is lowered, the rear legs 16 and the rear auxiliary legs 18 are pulled by the rear leg auxiliary frames 17 and move backward. A basic structure of the stretcher 10 is disclosed in Patent document 4 (Japanese Unexamined Patent Application Publication No. 2008-99952) and the six-wheeled stretchers 100, 200 according to the present invention are improvements of the stretcher 10.

Figure 3A:
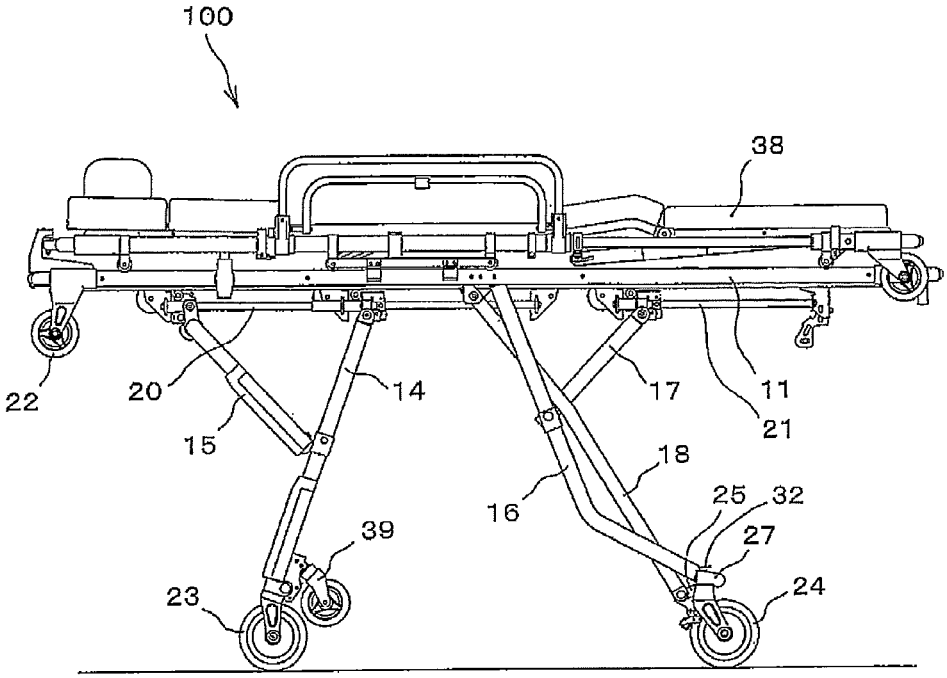
FIG. 3A is a side view showing a six-wheeled stretcher with 4-inch auxiliary casters.

In FIG. 3A, both ends of support arms 25 are axially attached to the lower ends of the rear auxiliary legs 18, link operation parts 27 for supporting rotatable casters 24 are axially attached to front ends of the support arms 25 and the lower ends of the rotatable casters 24 and rear legs 16 are axially attached to the link operation parts 27. Even when the six-wheeled stretcher 100 is set to the low position, axes of the rotatable casters 24 can be vertically held by the rear auxiliary legs 18 through the rear legs 16 and the support arms 25. In the six-wheeled stretcher 100, 4-inch rotatable auxiliary casters 39 are provided above the front leg fixed casters 23.

Figure 3B:
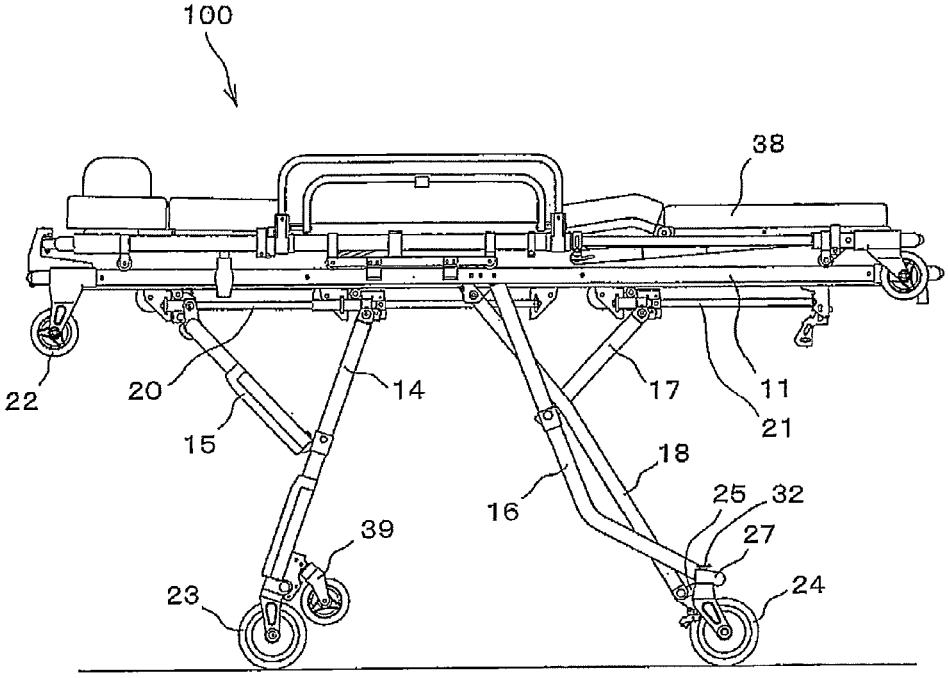
FIG. 3B is a side view showing the state where the six-wheeled stretcher with the 4-inch auxiliary casters is fixed at a position lower than an intermediate stage.

FIG. 3B is a side view showing the state where the six-wheeled stretcher 100 according to the present invention is set from the highest height to a position lower than the intermediate position. At the position lower than the intermediate position, the patient is transferred from a bed to the stretcher or from the stretcher to the bed. Even when the six-wheeled stretcher 100 is set from the highest position to the position lower than the intermediate position, as shown in FIG. 3B, the rotatable casters 24 are located vertical to the grounded surface by providing the link operation parts 27 and the rear auxiliary legs 18. When the stretcher is gradually lowered to the position lower than the intermediate position, the front leg fixed casters 23 float from the grounded surface, and the 4-inch rotatable auxiliary casters 39 contact the ground and together with the rotatable casters 24 of the rear legs, support the six-wheeled stretcher 100 in a stable state. When the six-wheeled stretcher according to the present invention 100 is set to the position lower than the intermediate position, both of the rotatable auxiliary casters 39 attached to the front legs 14 and the rotatable casters 24 of the rear legs 16 are made rotatable, resulting in quick receiving and transporting of the patient. In addition, lifesaving treatment such as cardiac massage can be also easily performed.

As described above, when the six-wheeled stretcher 100 is set to the position lower than the intermediate position, the auxiliary casters 39 provided above the front leg fixed casters 23 in place of the front leg fixed casters 23 contact the ground. However, at the lowest position of the six-wheeled stretcher 100, the auxiliary casters 39 in place of the front leg fixed casters 23 may contact the ground. The height and position of the six-wheeled stretcher 100 at the time when the auxiliary casters 39 in place of the front leg fixed casters 23 are not specially limited and may be appropriately changed according to intended purpose of the six-wheeled stretcher 100.

Figure 3C:
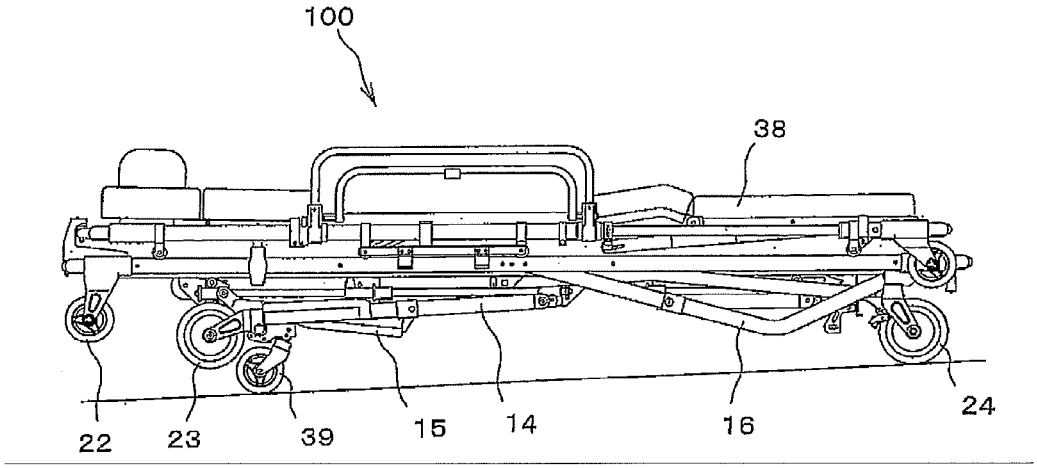
FIG. 3C is a side view showing the state where the six-wheeled stretcher with the 4-inch auxiliary casters is fixed in a lowest stage.

FIG. 3C shows the state where the six-wheeled stretcher 100 according to the present invention is set to the lowest stage. When the six-wheeled stretcher 100 according to the present invention is set to the lowest stage, the six-wheeled stretcher has a proper height so that the user can lean forward to receive the injured patient or perform cardiac massage. Further, by providing brake mechanisms at the rotatable casters 24 of the rear legs 16, when the six-wheeled stretcher 100 according to the present invention is set to the lowest position, brakes are automatically applied on the rotatable casters 24. Even when the six-wheeled stretcher 100 according to the present invention is set to the lowest position to receive the patient on the slope land, since the rotatable casters 24 of the six-wheeled stretcher 100 are automatically fixed by the fixing brakes, the patient can be received at ease.

In the six-wheeled stretcher 100 according to the present invention, although the number of stages for adjusting the height of the front legs 14 and the rear legs 16 is set to eight, six-wheeled stretcher 100, the number of height adjusting stages of the six-wheeled stretcher is not limited to eight and may be appropriately changed to any number such as three or five according to a usage place of the six-wheeled stretcher 100, a stretcher-mounted vehicle and the like.

Figure 3D:
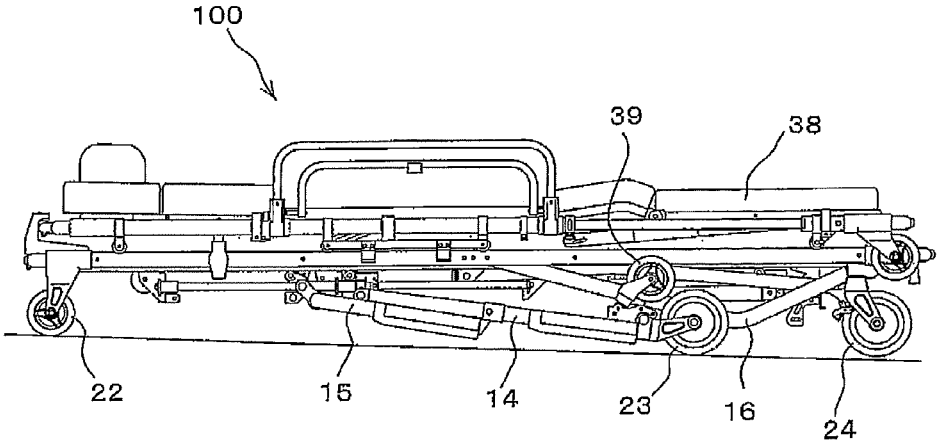
FIG. 3D is a side view showing the shape of the six-wheeled stretcher with the 4-inch auxiliary casters, which is to be mounted in an ambulance car.

FIG. 3D is a side view showing the shape of the six-wheeled stretcher 100 according to the present invention when mounted in the ambulance car or the like. When the six-wheeled stretcher 100 shown in FIG. 3A is pushed from the rear, the front leg auxiliary frames 15 contact the frame of the ambulance car or the like, and when the six-wheeled stretcher 100 is further pushed, the front legs 14 are folded backward and finally take the form shown in FIG. 3D. A front section of the stretcher 100 is supported by the fixed caster 22 and a rear section is supported by the front leg fixed casters 23 and the automatically-braked rotatable rear casters 24.

Figure 4A:
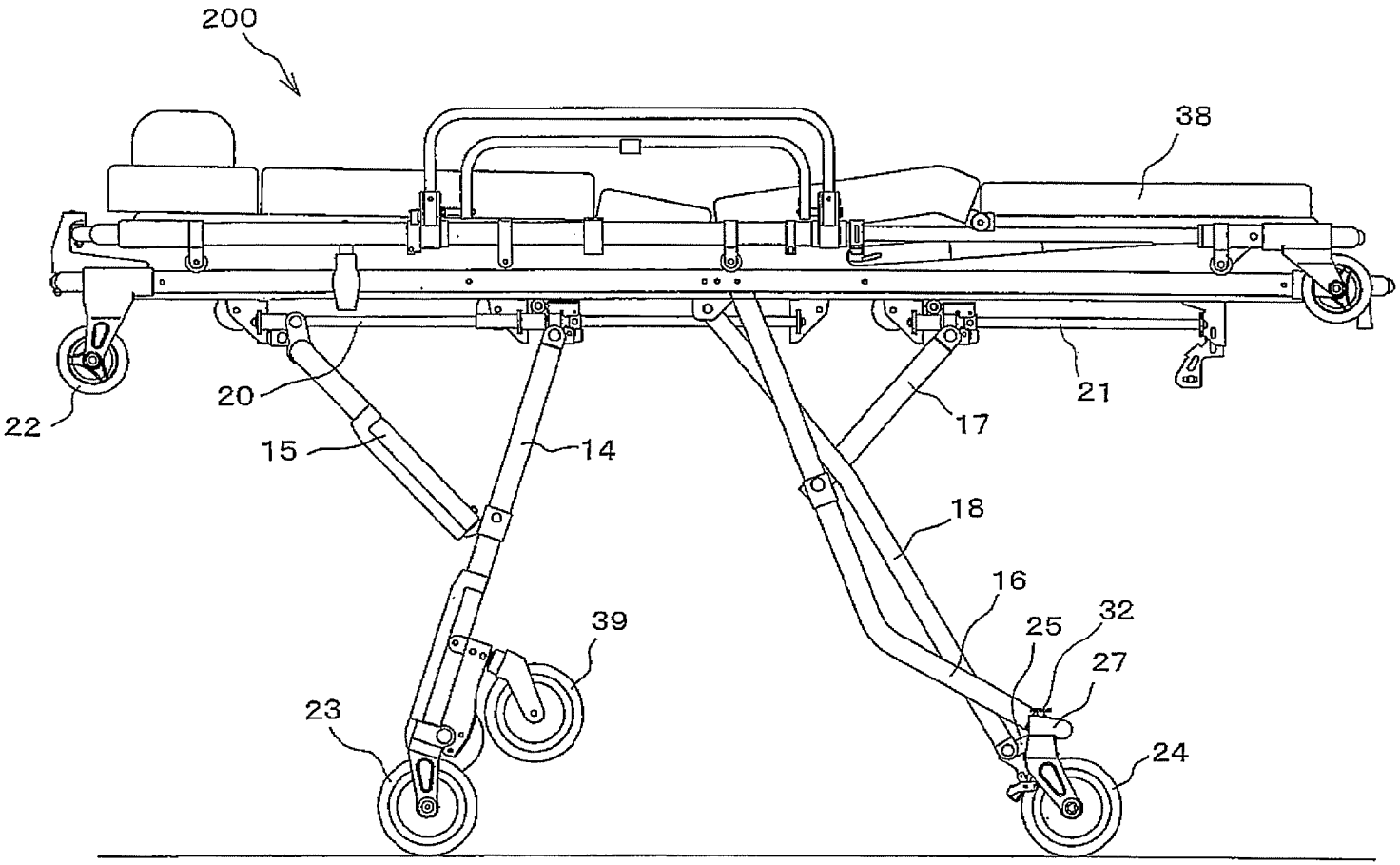
FIG. 4A is a side view showing the six-wheeled stretcher with 6-inch auxiliary casters.

In FIG. 4A, lower ends of the rear auxiliary legs 18 of the six-wheeled stretcher 200 according to the present invention are axially attached to both ends of the support arms 25, the link operation parts 27 of the rotatable casters 24 are axially attached to arms 25 *a* (not shown, refer to FIG. 8A) of the support arms 25 and the lower ends of the rotatable casters 24 and the rear legs are axially attached to the link operation parts 27. In the six-wheeled stretcher 200, the axes of the rotatable casters 24 can be vertically held by the rear auxiliary legs 18 through the rear legs 16 and the support arms 25. In the six-wheeled stretcher 200 shown in this figure, 6-inch rotatable auxiliary casters 39 are provided above the front leg fixed casters 23.

By using the 6-inch rotatable auxiliary casters 39 as the auxiliary casters 39 provided above the front leg fixed casters 23 of the six-wheeled stretcher 200, when the six-wheeled stretcher 200 is lowered for cardiac massage, even if one applies force on the patient from above, the stretcher is stable. Further, also when the six-wheeled stretcher 200 transports the patient in the low state, unsteadiness is reduced, thereby improving stability.

Figure 4B:
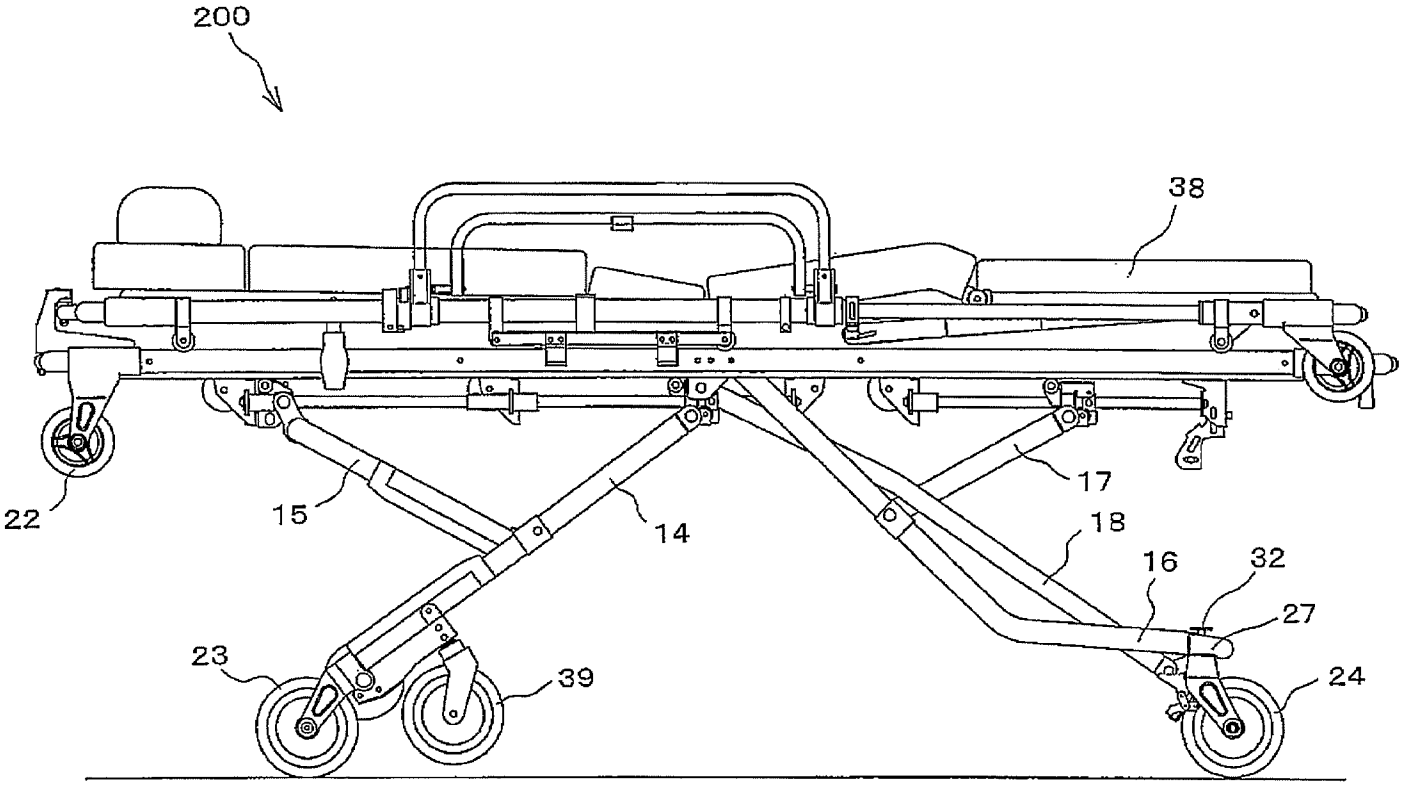
FIG. 4B is a side view showing the state where the six-wheeled stretcher with the 6-inch auxiliary casters is fixed in an intermediate stage.

FIG. 4B is a side view showing the state where the six-wheeled stretcher 200 according to the present invention is set from the highest position (about 1050 mm) to the intermediate position (about 835 mm). The six-wheeled stretcher 200 set from the highest position to the intermediate position is supported by the front leg fixed casters 23 and the rotatable casters 24 of the rear legs. This height is suitable for transferring the patient from the bed to the stretcher or from the stretcher to the bed.

Figure 4C:
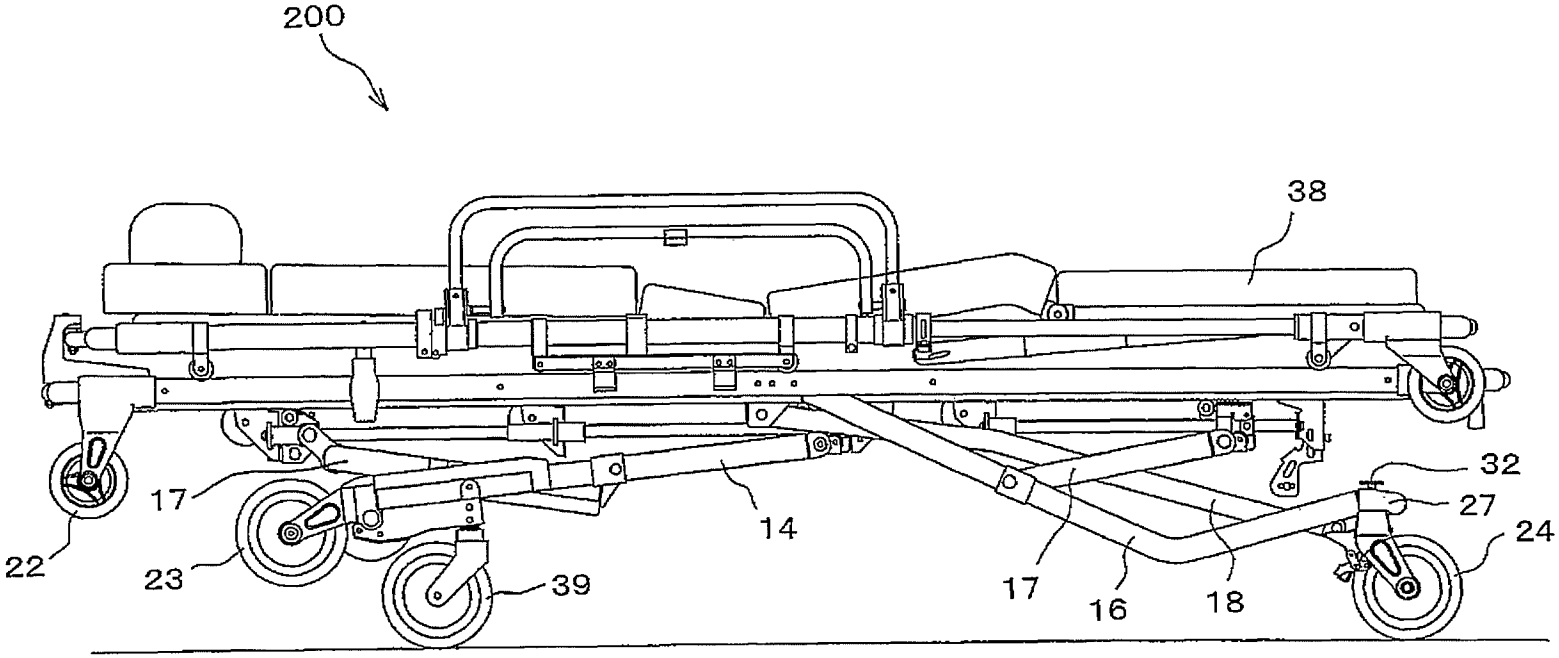
FIG. 4C is a side view showing the state where the six-wheeled stretcher with the 6-inch auxiliary casters is fixed in a lowest stage.

FIG. 4C shows the state where the six-wheeled stretcher 200 is lowered to a position lower than the intermediate position (about 550 mm). In this state, the front leg fixed casters 23 of the stretcher 200 floats from the grounded surface, and the 6-inch rotatable auxiliary casters 39 contact the ground, and together with the rotatable casters 24 of the rear legs, support the six-wheeled stretcher 200. When the six-wheeled stretcher 200 is set to the low position, the grounded rotatable auxiliary casters 39 of the front legs and rotatable casters 24 of the rear legs rotate, so that the patient can be rapidly received and transported. It is desired that the height of the stretcher at the low position falls within a range of 300 mm to 700 mm from the floor surface in the state where the lifter with a mat is mounted. At this height, lifesaving treatment such as cardiac massage can be easily performed, the patient can be easily transported, and loads applied to the ambulance crew who leans forward can be reduced.

Although the 4-inch auxiliary casters 39 (six-wheeled stretcher 100) and the 6-inch auxiliary casters 39 (six-wheeled stretcher 200) are employed in the above-mentioned embodiment as the auxiliary casters provided above the front leg fixed casters 23 of the six-wheeled stretcher 200 according to the present invention, the size of the auxiliary casters 39 is not limited to these inches. In consideration of running stability or the like in the case where lifesaving operations such as cardiac massage is performed or the patient is transported on the six-wheeled stretchers 100, 200 grounded by the auxiliary casters 39 and the rotatable casters 24 of the rear legs, auxiliary casters of 2 to 8 inches may be employed.

Figure 4D:
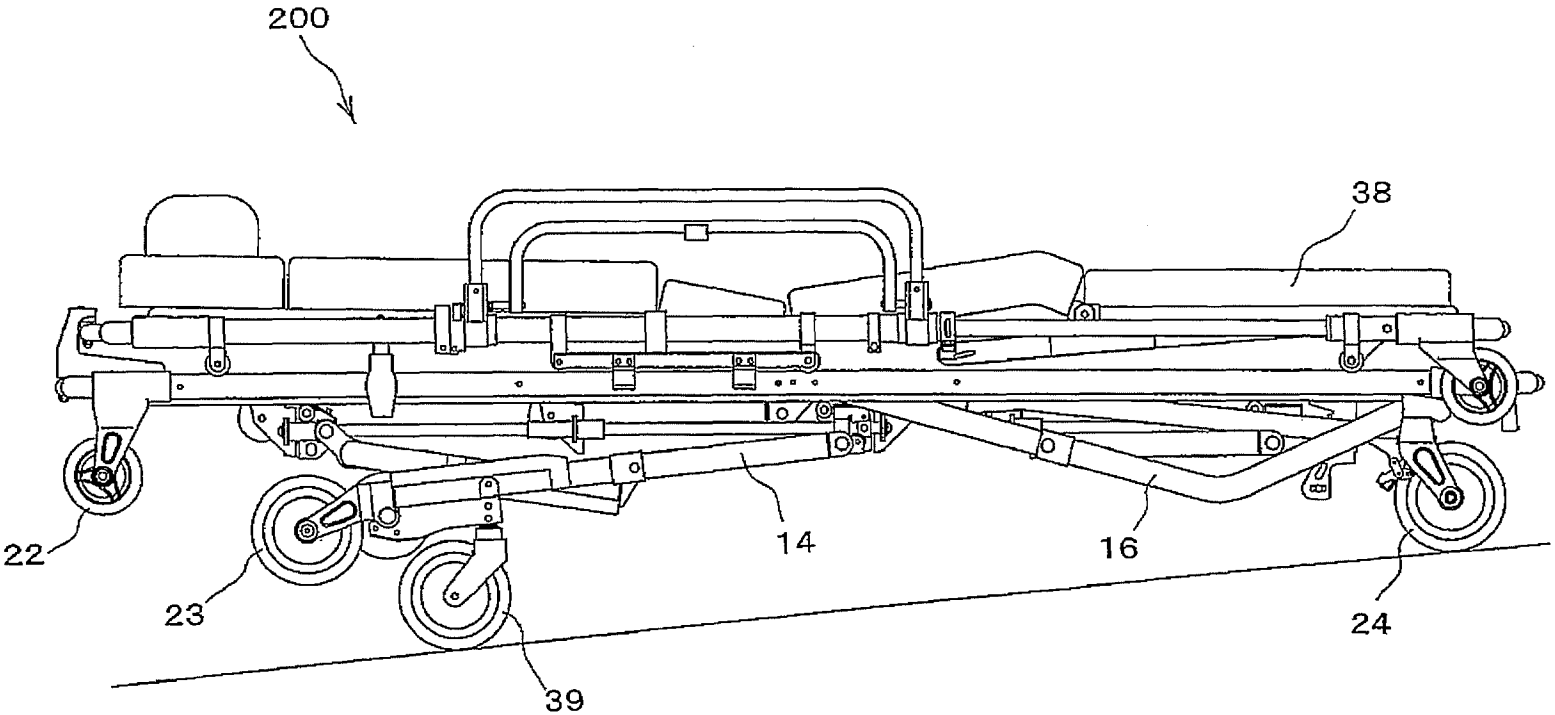
FIG. 4D is a side view showing the state where the six-wheeled stretcher with the 6-inch auxiliary casters is fixed in the lowest stage by fixing rotatable rear leg casters.

FIG. 4D shows the state where a rear section of the six-wheeled stretcher 200 with the 6-inch rotatable auxiliary casters 39 is set to a further lower position. By further lowering the rear section, the upper frame 11 presses brake buttons 32 (refer to FIG. 8A) and applies brakes on the rotatable casters 24 of the rear legs. The state is effective for the operation of receiving the patient in an uneven place.

According to the present invention, in the six-wheeled stretcher 200, although the front legs can be adjusted to three stages and the rear legs can be adjusted to four stages, the front legs may be adjusted to four stages and the rear legs may be adjusted to five stages. The height of the stretcher is not limited to this and may be appropriately determined according to intended purposes such as use for the ambulance car or the mourning coaches.

Figure 4E:
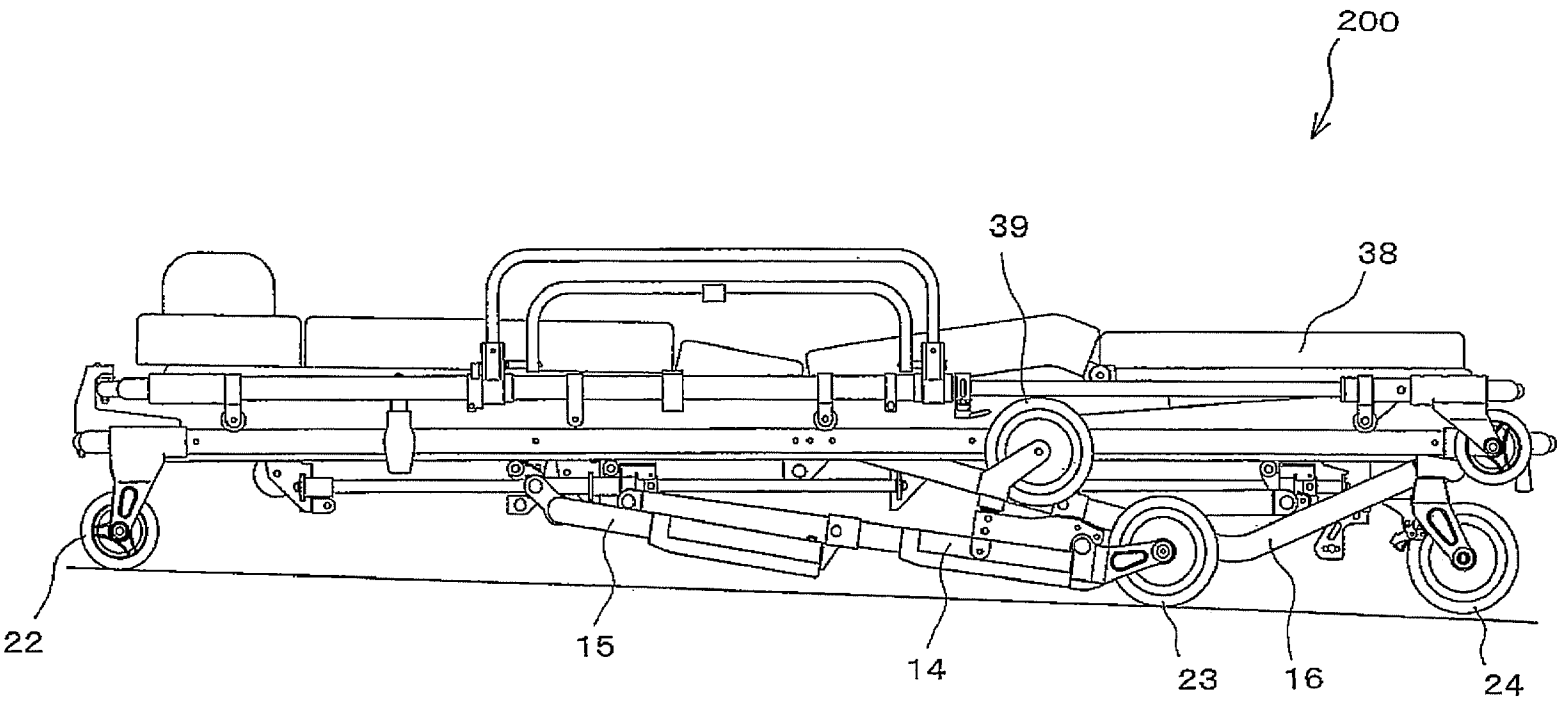
FIG. 4E is a side view showing the shape of the six-wheeled stretcher with the 6-inch auxiliary casters, which is to be mounted in the ambulance car.

FIG. 4E shows the shape of the six-wheeled stretcher 200 according to the present invention to be mounted in the ambulance car. When at the highest position shown in FIG. 4A, the stretcher is pushed from the side of the rear legs 16, the front leg auxiliary frames 15 come in contact with the frame of the ambulance car and the front legs 14 are pushed backward. As a result, the fixed casters 23 of the front legs 14 is folded toward the rotatable casters 24 of the rear legs 16 as shown in FIG. 4E and is mounted in the ambulance car or the like. The stretcher 200 is supported by the fixed caster 22 of the front section of the upper frame 11, the fixed casters 23 of the front legs 14 and the rotatable casters 24 of the rear legs 16, and the auxiliary casters 39 are located above the front fixed casters 23.

Figure 5A:
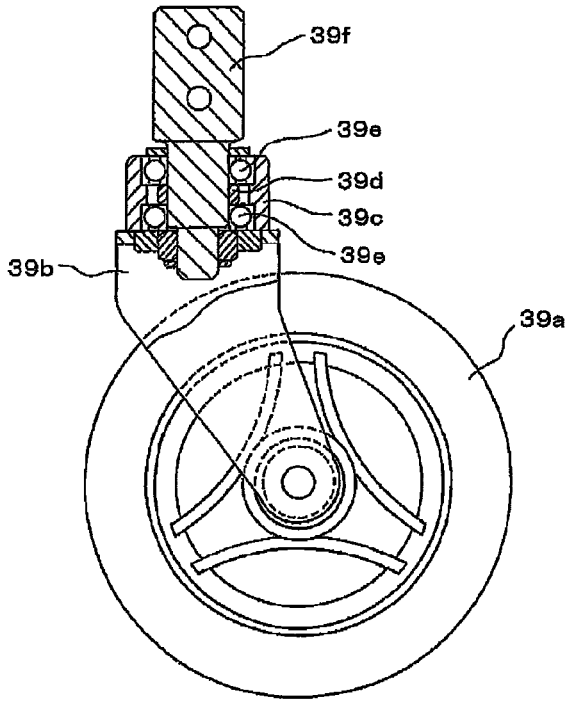
FIG. 5A is a side view showing the 4-inch auxiliary caster.

FIG. 5A shows the rotatable auxiliary casters 39 provided above the fixed casters 23 of the front legs 14. In each of the auxiliary casters 39, a caster wheel 39 *a* is axially attached to a caster yoke 39 *b* having a caster shaft 39 *f* a bearing 39 *e* and a caster collar 39 *d*.

Figure 5B:
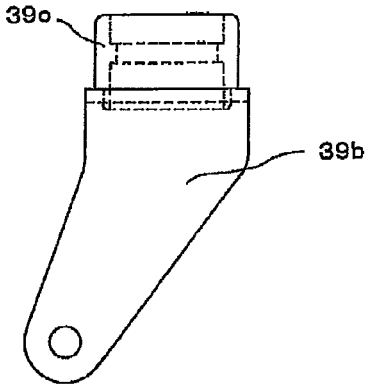
FIG. 5B is a side view showing a caster yoke of the 4-inch auxiliary caster.

FIG. 5B is a side view showing the caster yoke 39 *b* to which a caster boss 39 *c* and the caster wheel 39 *a* of the rotatable auxiliary caster 39 are axially attached. According to the present invention, although these parts are combined, part or all of the parts may be integrally formed and the rotatable auxiliary casters 39 are not limited to this structure.

Figure 5C:
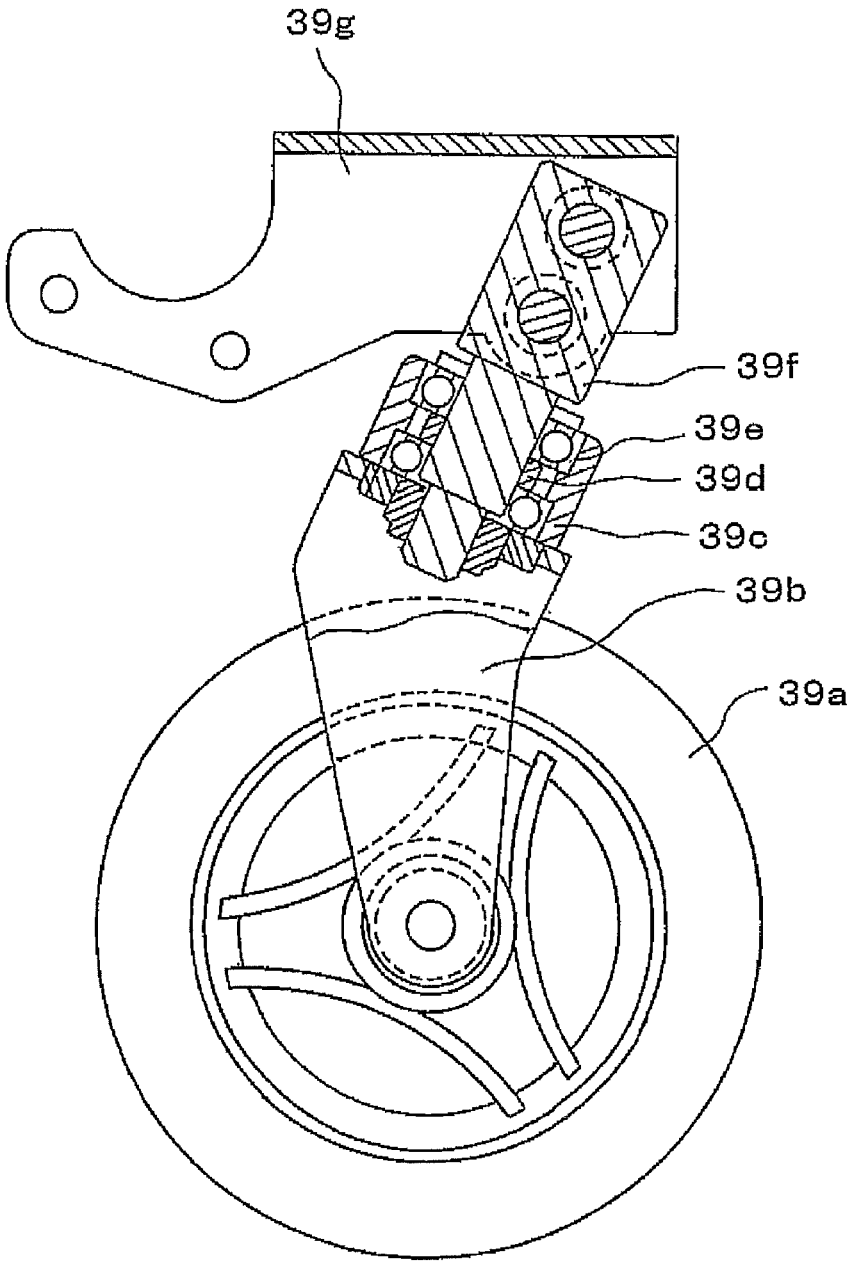
FIG. 5C is a side view showing the 4-inch auxiliary caster to be attached to a front frame.

FIG. 5C is a side view of the rotatable auxiliary casters 39 in which the caster wheel 39 *a* is axially attached to the caster yoke 39 *b* having the caster shaft 39 *f* the bearing 39 *e*, and the caster collar 39 *d*, and a caster bracket 39 *g* is attached to the caster shaft 39 *f*

The caster bracket 39 *g* of the auxiliary caster 39 and a caster yoke 23 *a* of the fixed casters 23 may be integrally formed and the method of attaching the fixed casters 23 and the auxiliary casters 39 are not limited to the above-mentioned method.

Figure 5D:
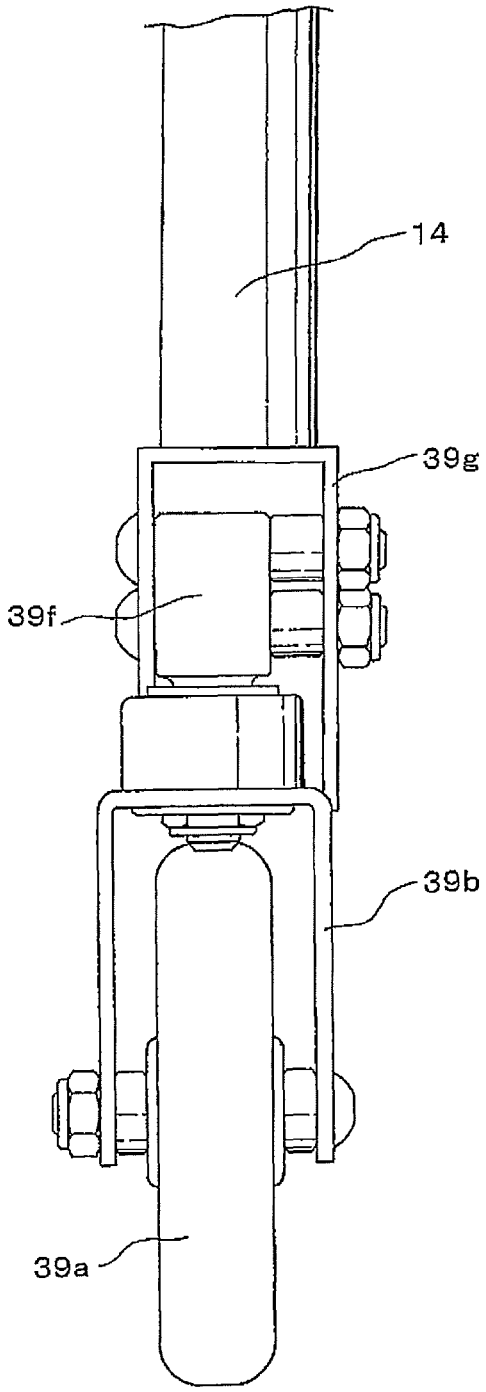
FIG. 5D is a rear view showing the 4-inch auxiliary caster attached to the front leg frame.

FIG. 5D is a back view showing the state where the caster wheel 39 *a* is axially attached to the caster yoke 39 *b* having the caster shaft 39 *f* the bearing 39 *e* and the caster collar 39 *d* of the rotatable auxiliary casters 39, and the caster bracket 39 *g* attached to the front leg 14 is attached to the caster shaft 39 *f*.

Figure 6A:
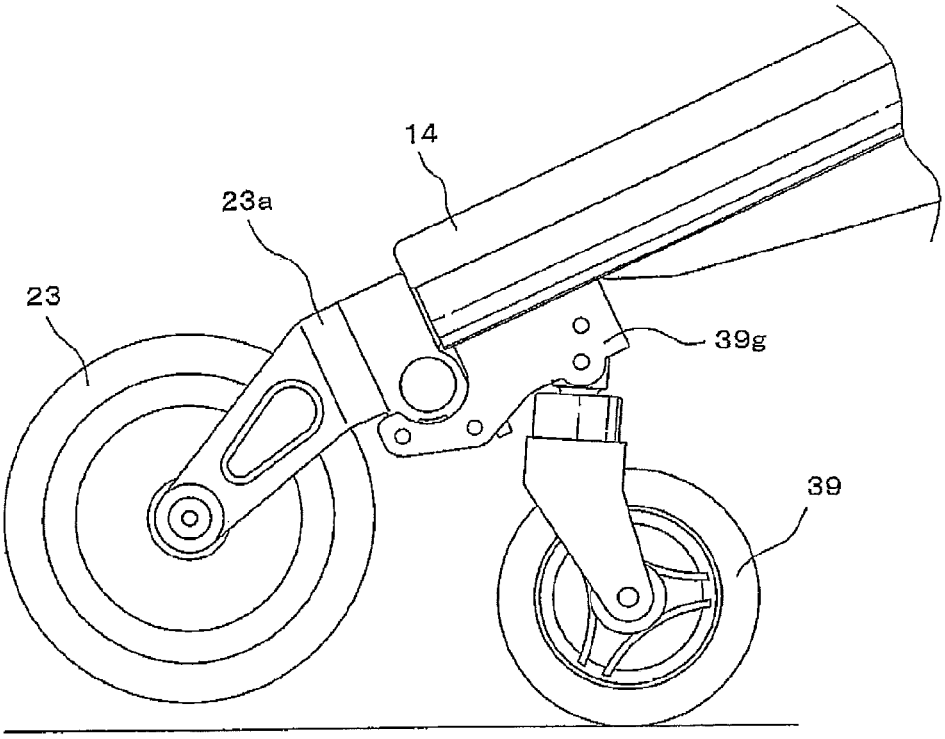
FIG. 6A is a side view showing the front leg frame and the 4-inch auxiliary caster attached above the front leg caster.

FIG. 6A is a side view showing the state where the six-wheeled stretcher 100 according to the present invention with the 4-inch auxiliary casters 39 are gradually lowered, the front leg fixed casters 23 are fixed and the rotatable auxiliary casters 39 contact the ground. When the rotatable auxiliary casters 39 contact the ground, the front leg fixed casters 23 float from the grounded surface and the front legs 14 of the six-wheeled stretcher 100 are supported by the rotatable auxiliary casters 39.

Figure 6B:
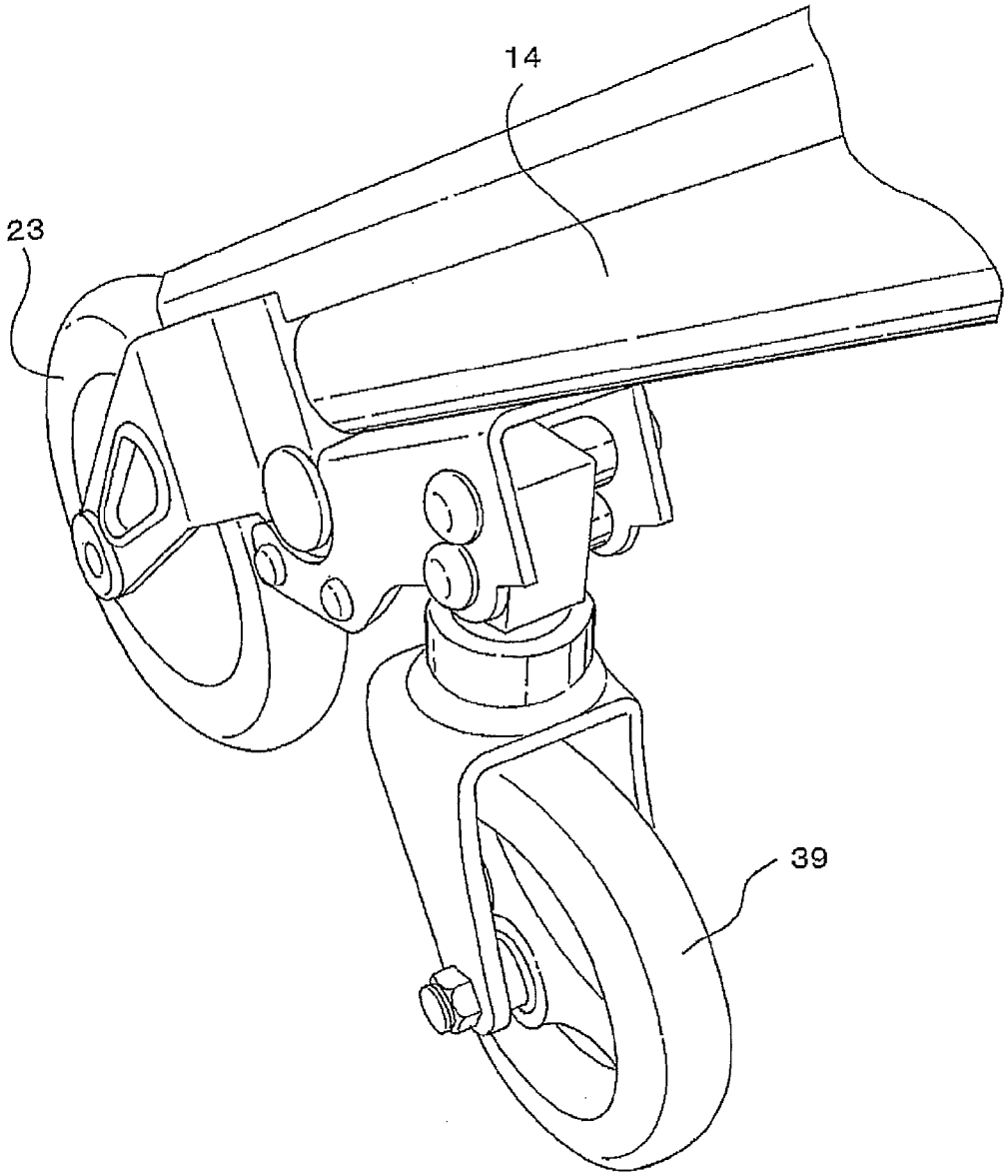
FIG. 6B is a Perspective view showing the front leg frame and the 4-inch auxiliary caster attached above the front leg caster when viewed from behind.
Figure 7A:
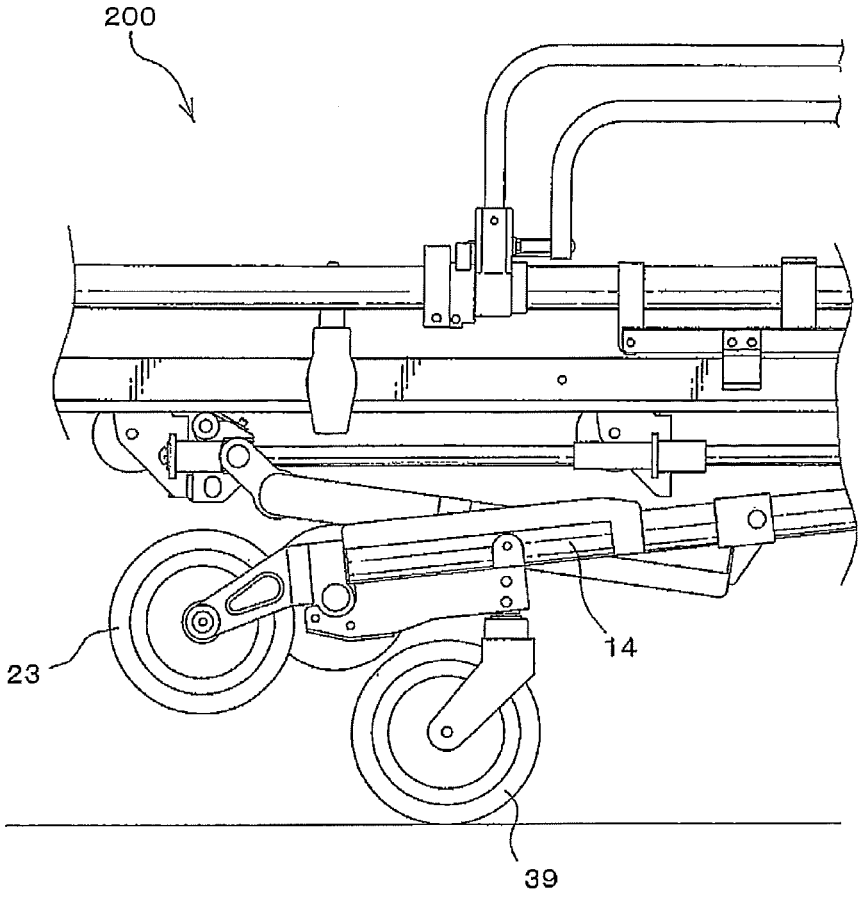
FIG. 7A is a partial side view showing the front leg fixed caster and the 6-inch auxiliary caster in the state where the six-wheeled stretcher is set to the lowest stage.

FIG. 6B is a perspective view from behind showing the state where the six-wheeled stretcher 100 according to the present invention with the 4-inch auxiliary casters 39 are gradually lowered, the fixed casters 23 of the fixed front legs 14 float from the grounded surface and the rotatable auxiliary casters 39 contact the ground when viewed:

FIG. 7A is a partial side view showing the case where the six-wheeled stretcher 200 according to the present invention with the 6-inch auxiliary casters 39 are gradually lowered, the fixed casters 23 of the fixed front legs 14 and the rotatable auxiliary casters 39 contact the ground. When the rotatable auxiliary casters 39 contact the ground, the front leg fixed casters 23 float from the grounded surface and the six-wheeled stretcher 200 is supported by the rotatable auxiliary casters 39 of the front legs 14.

Figure 7B:
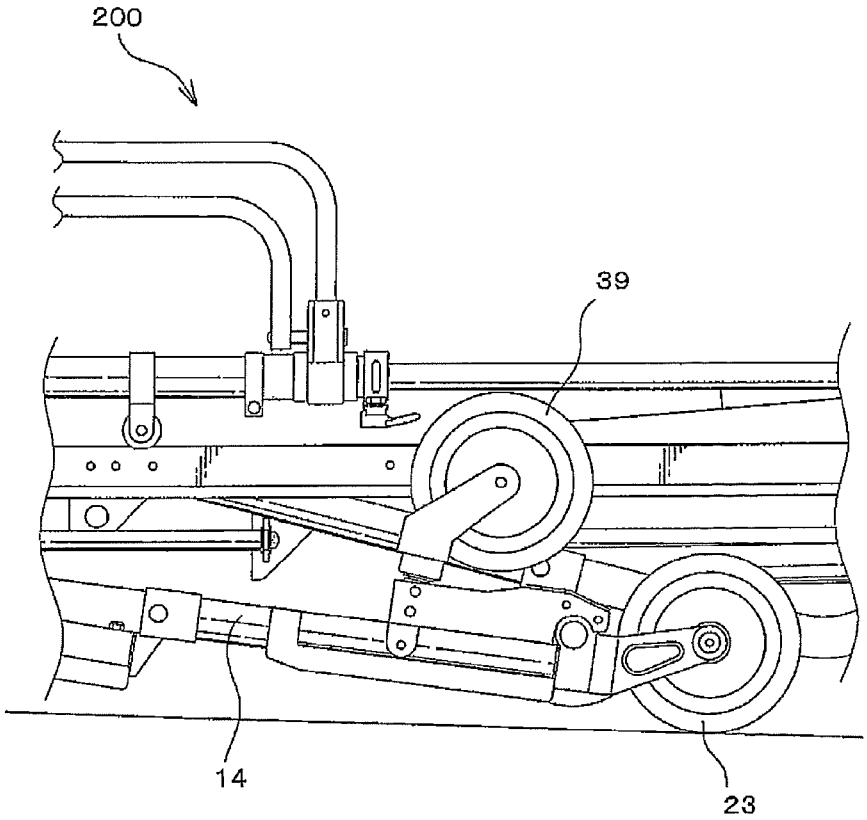

FIG. 7B is a partial side view showing positional relationship between the fixed casters 23 of the front legs 14 and the rotatable auxiliary casters 39 in the state where the six-wheeled stretcher 200 according to the present invention with the 6-inch auxiliary casters 39 is mounted in the ambulance car or the like. The rotatable auxiliary casters 39 are located above the fixed casters 23 of the front legs 14 and the fixed casters 23 of the front legs 14 contact the ground.

In the embodiment of this application, although the front legs can be adjusted to three stages and the rear legs can be adjusted to four stages, the front legs may be adjusted to four stages and the rear legs may be adjusted to five stages, and the number of stages is not limited to three on the side of the front legs and four on the side of the rear legs.

Figure 8A:
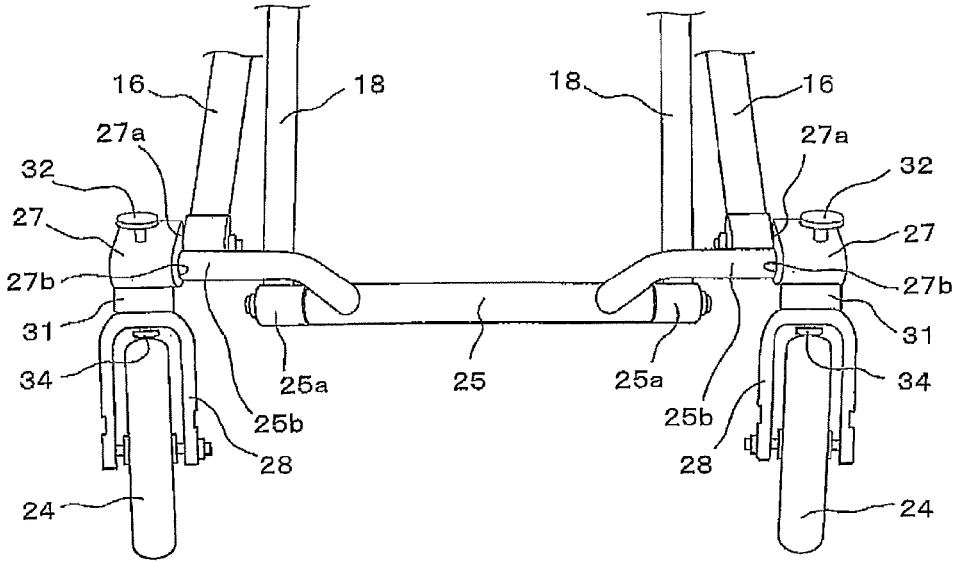
FIG. 8A is a partial rear view showing the rotatable rear leg casters and the rear legs in the attached state (the rear leg casters of the stretcher).

FIG. 8A shows shape and positional relationship of the brake buttons 32 of the fixing brakes 31 for pressing and fixing the rotatable casters 24 attached to the rear legs 16 at the upper frame 11 of the six-wheeled stretchers 100, 200, the rear legs 16, the rear auxiliary legs 18 and the support arms 25. The brake buttons 32 of the fixing brakes 31 attached to the rotatable casters 24 of the rear legs 16 protrude from the link operation parts 27 above the rotatable casters 24 so as to be pressed by the upper frame 11. When the stretcher is lowered while folding the legs, at the time when the upper frame 11 are put into the lowest stage, the upper frame 11 contact the brake buttons 32 of the fixing brakes 31, thereby pushing the brake buttons 32 downward, resulting in that press parts 34 press and fix the tires through brake shafts 33. As described above, even when the braking operation is not performed, when the upper frame 11 is lowered to the lowest stage, the fixing brakes 31 are applied. Thus, the patient can be placed in the six-wheeled stretcher 200 in safety without forgetting to brake.

Figure 8B:
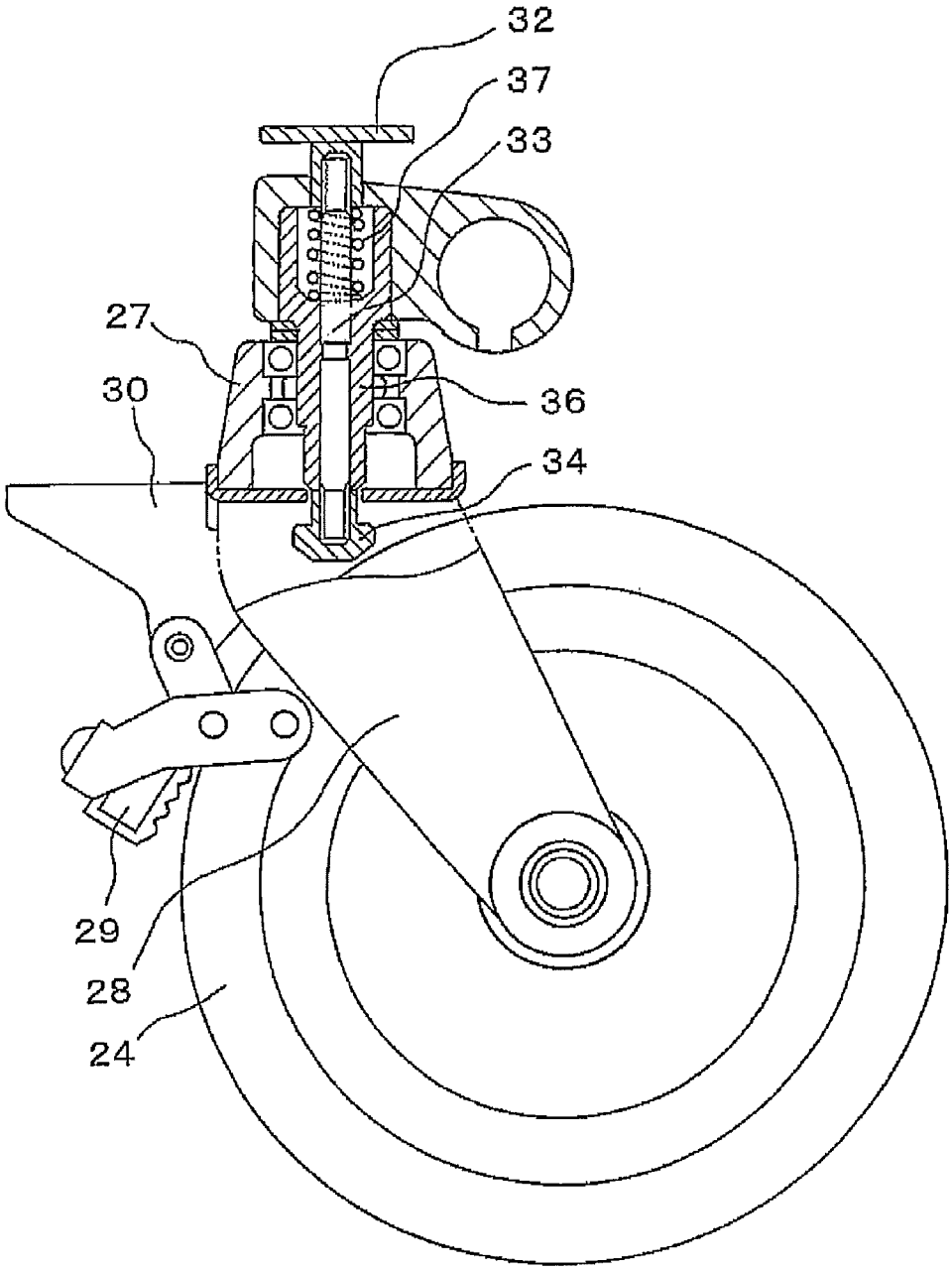
FIG. 8B is a partial rear view showing the rotatable rear leg casters and brake buttons in the attached state.

FIG. 8B shows the state where the fixing brakes 31 are attached through caster shafts 36. The fixing brakes 31 are attached to the caster shafts 36. When the brake buttons 32 are pressed by the upper frame 11, force is transmitted through the brake shafts 33 in the caster shafts 36 and the press parts 34 strongly presses the wheels of the rotatable casters 24, thereby fixing the wheels. Spring members 37 are biased to the brake buttons 32 and the brake buttons 32 are generally in a disengaged state. The shape of the brake buttons 32 may be circular or rectangular and may be any shape as long as the fixing brakes 31 operate by pressure of the upper frame 11 when the legs are folded.

Figure 8C:
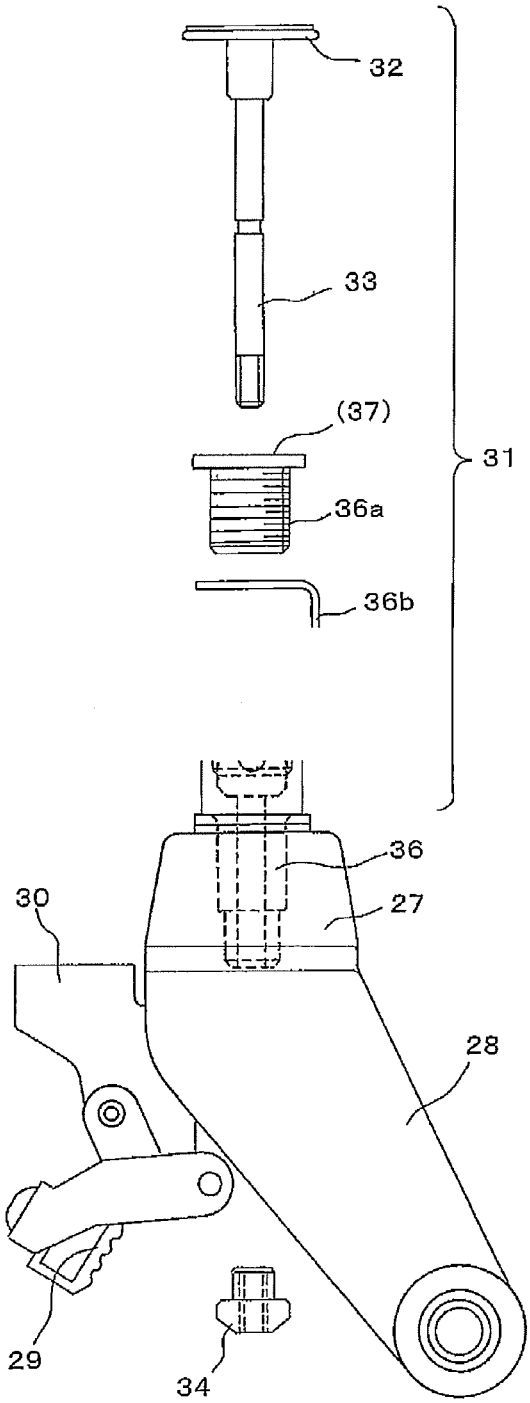
FIG. 8C is a side view showing components of a fixing brake.

FIG. 8C is a view showing the fixing brake 31 having a structure that is slightly different from the structure shown in FIG. 8B. The link operation parts 27 are attached above the rotatable casters 24 and ends of the support arms 25 and the rear legs frames 16 are attached in the link operation parts 27. The fixing brake 31 is provided on a caster yoke 28 of the rotatable caster 24 and through the link operation part 27. The fixing brake 31 is operated by the brake button 32 protruding upward from the link operation part 27, and the press part 34 presses and fixes the tire of the rotatable caster 24. A spring member (37, not shown) is biased to the brake button 32 and the brake button 32 is generally in the disengaged state. The shape of these brake buttons 32 may be circular or rectangular and may be any shape as long as the fixing brakes 31 operate by pressure of the upper frame 11 when the front and rear legs are folded. Foot brakes 29 are attached at the rear of the rotatable casters 24 and by pressing foot plates 30, the foot brakes 29 press and fix the tires.

As components of the fixing brakes 31, the brake buttons 32 protruding from heads of the link operation parts 27, the brake shafts 33 for transmitting force of the brake buttons 32, spring-biased hollow bolts 36 *a* below the brake shafts 33, washers 36 *b* for maintaining fastening of the bolts 36 *a*, caster shafts 36 and the press parts 34 for pressing the tires are provided. The brake button 32 and the brake shaft 33 for transmitting force of the brake button 32 may be integral as shown in this figure or may be separated. The structure may be specifically limited as long as the upper frame 11 can press the brake buttons 32, thereby causing the press parts 34 to press the tires.

Figure 8D:
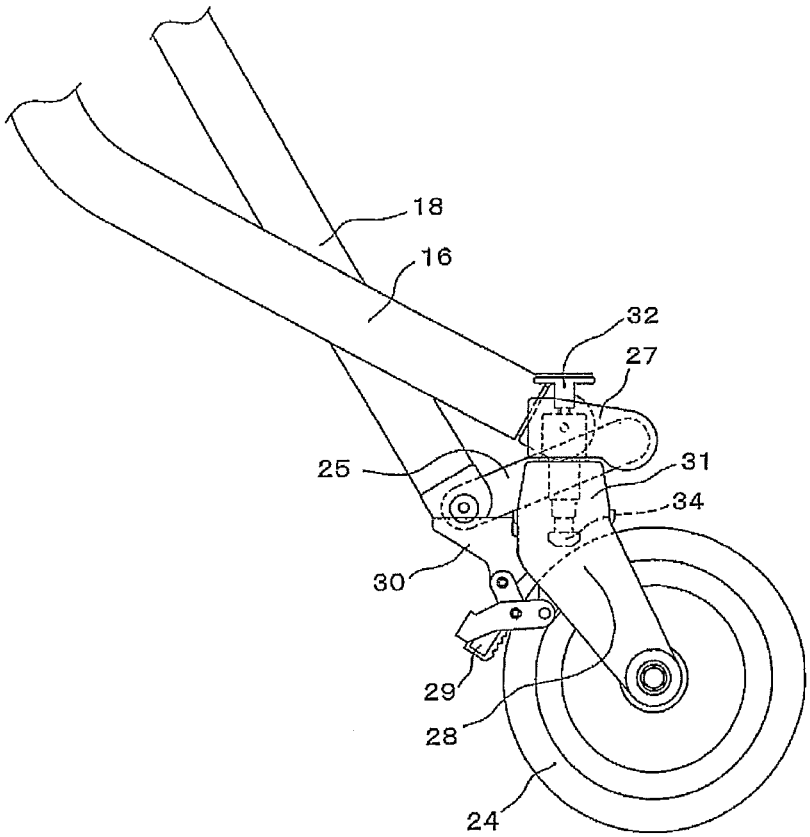
FIG. 8D is a partial side view showing the state where the rear leg casters are attached to the rear legs and rear leg auxiliary frames of the six-wheeled stretcher.

FIG. 8D shows the state where the upper frame 11 presses the brake buttons 32, thereby causing the press parts 34 of the fixing brakes 31 to press the tires of the rotatable casters 24. Although the foot brakes 29 are generally applied by pressing the brake pedals 30, when the stretchers 100, 200 are lowered to the lowest stage, it is difficult to press the pedals 30 of the foot brakes 29 and thus, the user may forget to press the pedals, which is very dangerous. Therefore, when the upper frame 11 of the six-wheeled stretchers 100, 200 is set to the lowest stage, the upper frame presses the brake buttons 32, thereby causing the fixing brakes 31 to press and fix the tires of the rotatable casters 24. In this manner, the user never forgets to press the foot brakes 31.

Figure 8E:
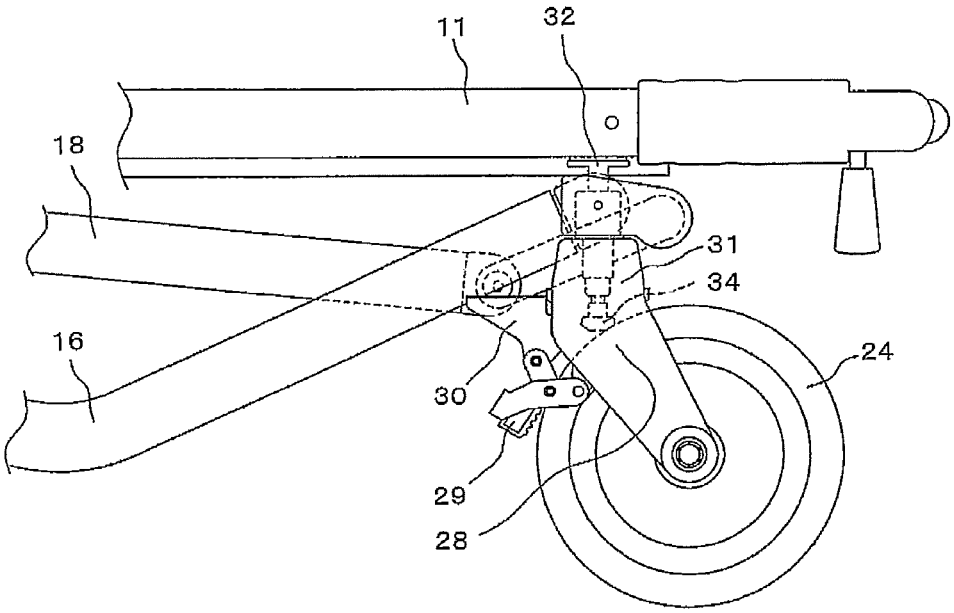
FIG. 8E is a partial side view showing the state where brake buttons of the rear legs of the six-wheeled stretcher are pressed by the upper frame.

FIG. 8E is a partial side view showing the state where the rear legs (16, 18) of the six-wheeled stretchers 100, 200 are folded to the lowest stage. The upper frame 11 presses the brake buttons 32 above the caster yoke 28 and the press parts 34 press and fix the wheels of the rotatable casters 24. An engaging mechanism of the fixing brakes 31 includes pressing the brake buttons 32 with the upper frame 11 and pressing the brake buttons 32 with a foot, and is not limited to pressing by the upper frame 11. As an example of a mechanism for engaging or disengaging the rotatable casters 24 by the fixing brakes 31, a mechanism of engaging the rotatable casters 24 at first pressing and disengaging the rotatable casters 24 at second pressing can be given. The mechanism for pressing, engaging and disengaging the rotatable casters 24 by the fixing brakes 31 is not limited to these, and may be any method as long as the tires of the rotatable casters 24 are fixed by pressing of the fixing brakes 31.

When the patient is received at a low position such as on road, since the patient can be received on the lifter at the low position and mounted on the six-wheeled stretcher 100, 200 at the position, loads exerted on the patient and the ambulance crew can be reduced. For this reason, the brake mechanisms according to the present invention that can reliably fix the six-wheeled stretchers 100, 200 to the low position are useful.

In this embodiment, the constant force springs are used to assist vertical movement of the legs of the stretcher 10 and the six-wheeled stretchers 100, 200. An example of the stretcher with spring members in place of the constant force springs will be described below.

Figure 9A:
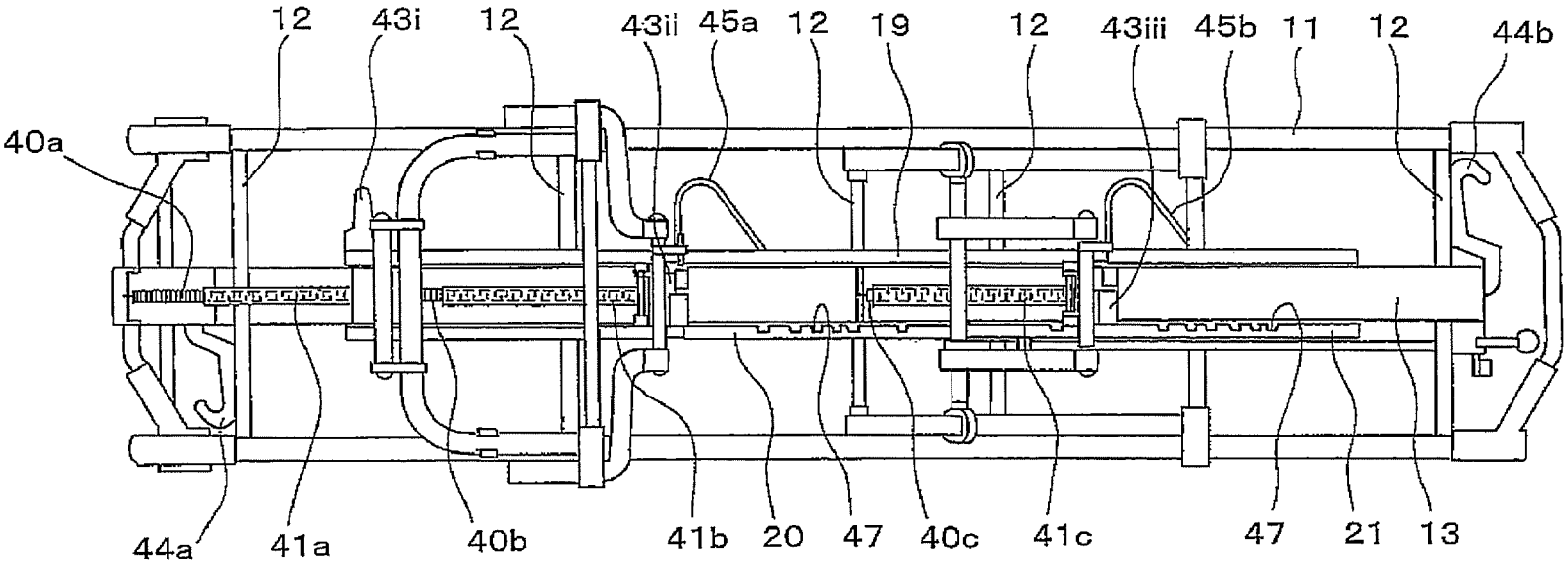
FIG. 9A is a back view showing the stretcher with spring members.

FIG. 9A is a back view showing positions of spring members 40 provided at the stretcher 300 in place of the constant force springs 26 (refer to FIG. 3B). To clarify the frame structure, FIG. 9A does not show the legs of the stretcher. Although the pipe shape of the rectangular upper frame 11 is not specifically limited, according to the present invention, a 29×34 mm elliptical pipe is used as the upper frame 11 to reinforce the upper frame 11. Further, although a 5-inch wheel can be used as the fixed caster 22, according to the present invention, the 4-inch wheel is provided. An 80×40 channel center rail 13 having a cross section in the shape of an inverted C is used.

Five inside frames 12 are horizontally mounted on the inner side of the upper frame 11 of the stretcher 300 according to the present invention. The center rail 13 having the cross section in the shape of an inverted C is attached to the inside frames 12. The slide tube 19 without a lock groove (refer to FIG. 12A) is attached to one side of the center rail 13, and the front leg slide tube 20 formed integrally with the front leg auxiliary frame slide tube with a lock groove, and the rear leg auxiliary frame slide tube 21 are attached to the other side of the center rail 13. A pin lock mechanism 43 *i* of the front leg auxiliary frame, a pin lock mechanism 43 *ii* of the front legs and a pin lock mechanism 43 *iii* of the rear leg auxiliary frame are slidably inserted into the slide tubes 20, 21. A pin lock mechanism 43 *i* of the front leg auxiliary frame has one lock groove (hole) 47 and a wire (not shown) for disconnection is connected to a rear lever 44 *b*. Lock grooves 47 on the pin lock mechanism 43 *ii* of the front legs and on the pin lock mechanism 43 iii of the rear leg auxiliary frame are made at respective positions as shown in FIG. 9A. For disconnection with the lock grooves 47, a front lever 44 *a* and the rear lever 44 *b* are connected to each other via a wire 45 *a* or a wire 45 *b*.

These basic structures are common to the stretcher 100, 200 and the below-mentioned stretcher 400.

Figure 9B:
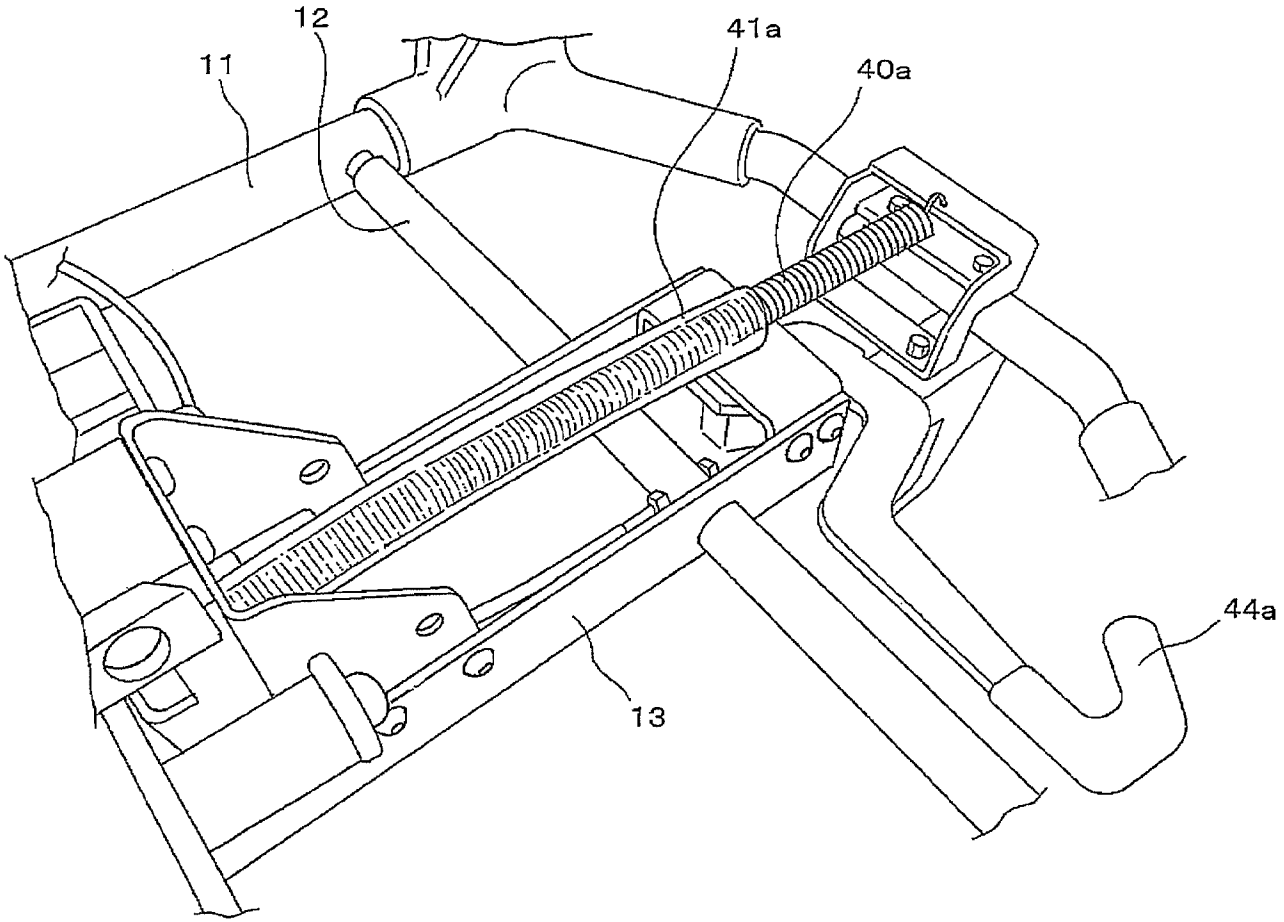
FIG. 9B is a partial back view showing the stretcher with the spring members.

FIG. 9B is an enlarged perspective view showing the state where the spring member 40 *a* is attached to the back surface of the upper frame 11 of the stretcher 300 according to the present invention. One end of the spring member 40 *a* of the front leg auxiliary frame 15 is fixed to the front end of the rectangular upper frame 11 and the other end is attached to the pin lock mechanism 43 *i* (refer to FIG. 9A) of the front leg auxiliary frame 15. By attaching a spring cover 41 *a* to the spring member 40 *a* of the front leg auxiliary frame 15, metal sound that the spring member 40 *a* generates when extended or contracted can be prevented. Further, metal sound that the spring member 40 *a* generates when hitting the center rail 13 and the like of the stretcher can be prevented. As shown in FIG. 9A, the spring member 40 *a* may be provided at two positions: between the front leg auxiliary frame 15 and the pin lock mechanism 43 *i* of the front leg auxiliary frame 15, and between the rear of the pin lock mechanism 43 *i* of the front leg auxiliary frame and the pin lock mechanism 43 *ii* of the front leg 14. Alternatively, the spring member 40 a to which the spring cover 41 is attached may be provided at the rear leg auxiliary frame 17 between the pin lock mechanism 43 *iii* of the rear leg auxiliary frame 17.

Figure 9C:
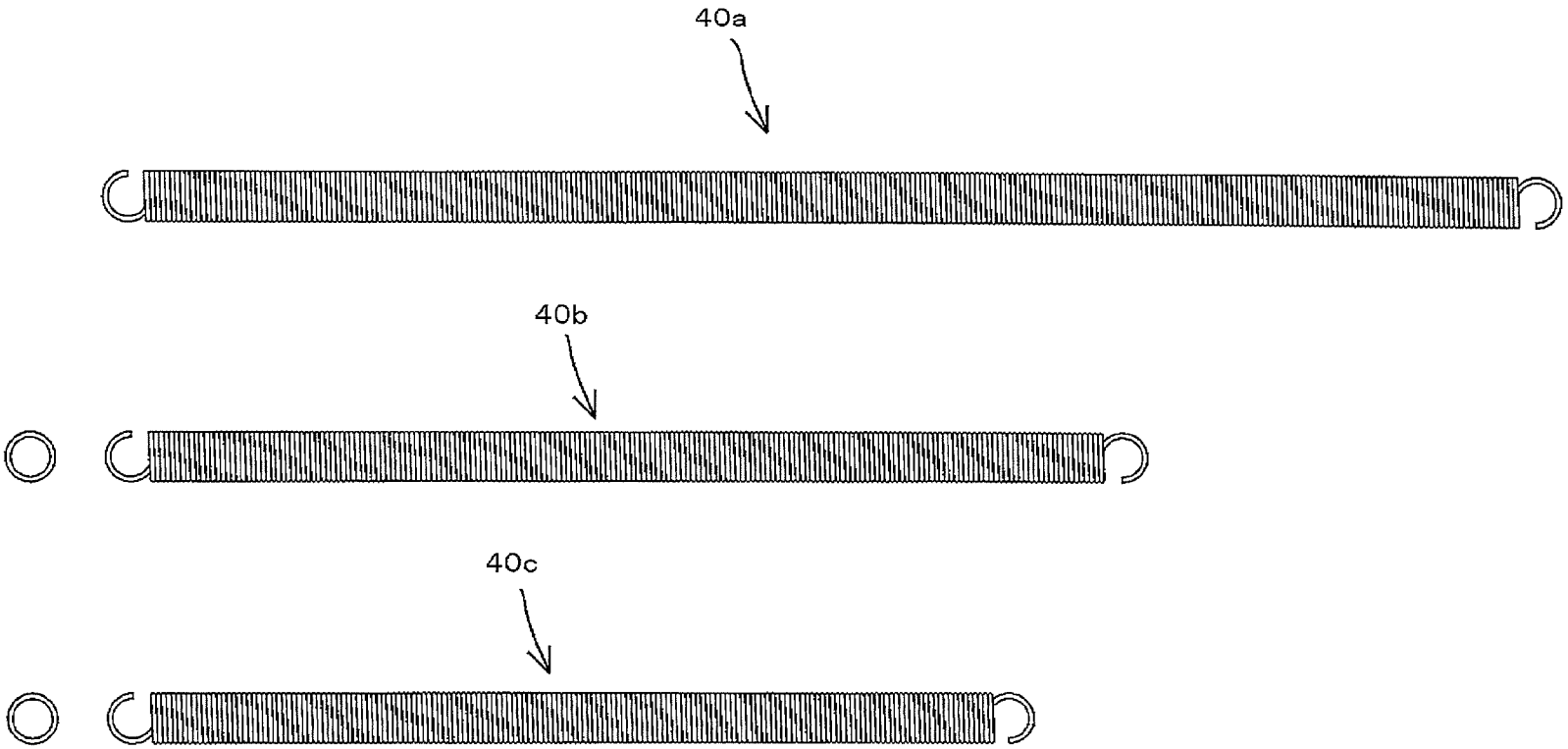
FIG. 9C is a Side views of the spring members.

As shown in FIG. 9C, SWP-B extension coil springs having a diameter of ϕ1.6 are used as the spring members 40 *a*, 40 *b*, 40 *c* according to the present invention. As shown in FIG. 9A, the three types of extension coil springs having a thickness of ϕ14 and lengths of 325 mm (a), 245 mm (b) and 200 mm (c), to which the spring cover is attached, are provided between the front end of the upper frame 11 and the pin lock mechanism 43 *i* of the front leg auxiliary frame 15 and between the rear of the pin lock mechanism 43 *i* of the front leg auxiliary frame and the pin lock mechanism 43 *ii* of the front leg 14. A spring fixing member may be provided between the upper end movable part of the rear leg auxiliary frame 17 and the upper frame 11 (in the vicinity of the rear leg rotating part of the inside frame 12, refer to FIG. 2) to provide the spring member 40, to which the spring cover 41 is attached, to a position in addition to the front legs. When the spring member 40, to which the spring cover 41 is attached, is attached between the fixing member and the rotating part of the pin lock mechanism 43 *iii* of the rear leg auxiliary frames 17, loads generated when the rear legs 14 extend and then return can be reduced.

Here, the three spring members 40 having the same spring output (tension strength) can be used: one for the front leg auxiliary frame 15, and two for the front leg 14 and the rear leg auxiliary frame 17. The spring output of the used spring members 40 varies depending on wire diameter, material and thickness. The spring members 40 are not limited to the above-mentioned members and a spring having a wire diameter of ϕ1.0 to 3.0, a thickness of ϕ10 to 30 and a length of 150 to 400 mm can be employed. The length of the spring members 40 varies depending on material, wire diameter and spring diameter, and is not specifically limited. Desirably, the material for the spring members 40 has high climate resistance and durability, but is not specifically limited.

The spring covers 41 covering the extension coil springs are desirably, synthetic resin tubes each having such a size that the inserted spring member 40 does not scratch the inner surface of the cover. Further, the synthetic resin tubes as the spring covers 41 may be rigid tubes or flexible soft tubes. Examples of a material for the tubes include teflon, nylon, urethane, silicon, vinyl chloride, synthetic rubber and natural rubber. Although the tubes having resistance to cold and resistance to climate are desirable, the material for the spring covers 41 is not specifically limited.

Figure 10A:
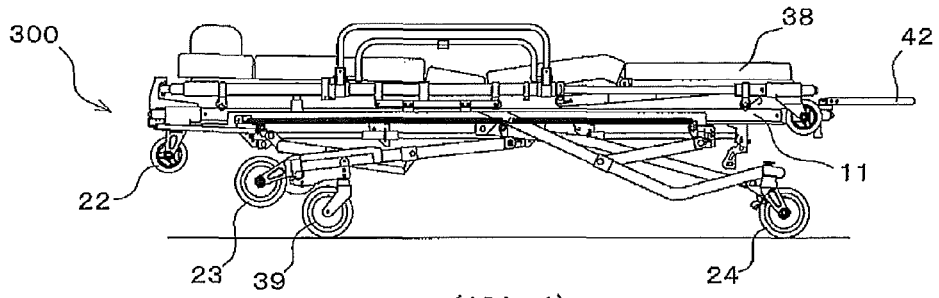
FIG. 10A is a Side views showing the stretcher with a handle.
Figure 10A:
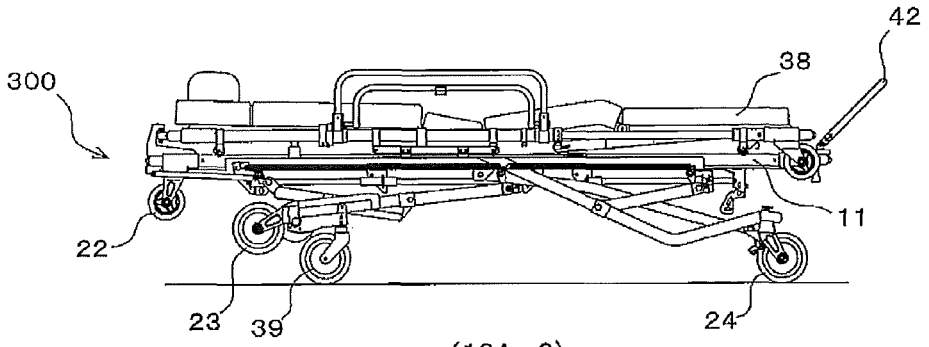
Figure 10A:
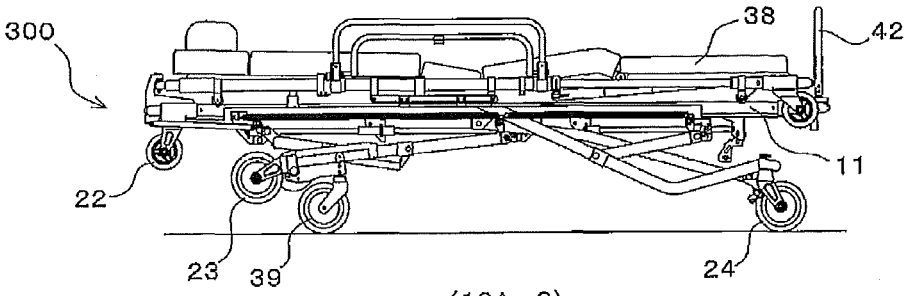
Figure 10A:
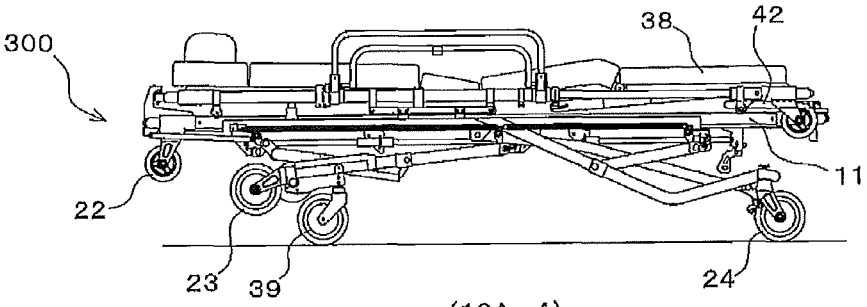

FIG. 10A are side views showing the stretcher 300 in which an handle arm 42 is provided at the rear of the upper frame 11. When the stretcher is used at the position lower than the intermediate position, the ambulance crew must generally act while leaning forward and thus, can hurt his/her lower back. To solve this problem, the tillable handle arm 42 shown in FIG. 10A is provided at the rear of the stretcher 300.

As shown in FIG. 10A (10A-1), the handle arm 42 is provided at the rear of the upper frame 11 of the stretcher 300. FIG. (10A-1) shows the state where the handle arm 42 is horizontal with respect to the upper frame 11. FIG. (10A-2) shows the state where the handle arm 42 is vertical with respect to the upper frame 11. FIG. (10A-3) shows the state where the handle arm 42 is bent toward the upper frame 11 and housed in the lifter 38. The handle arm 42 according to the present invention can be applied to the stretchers (100, 200, 300) according to the present invention as well as publicly known stretchers.

As shown in FIG. 10A-1, when the stretcher is brought into the ambulance car with the handle arm 42 being horizontal with respect to the upper frame 11, at the time of closing a door of the ambulance car, the handle arm 42 contacts the door, thereby damaging the door or giving a shock to the patient. When the handle arm 42 is bent by about 45 degrees as shown in FIG. 10A-2, the handle arm 42 contacts the door and then, is pushed upward to be in the state shown in FIG. 10A-3. For this reason, it is desired that the handle arm 42 is used in the state shown in FIG. 10A-2. Although the angle of the handle arm is described as about 45 degrees, the angle is not limited to 45 degrees and may be any angle at which the handle arm can contact the door and be folded in the direction of the front legs.

Figure 10B:
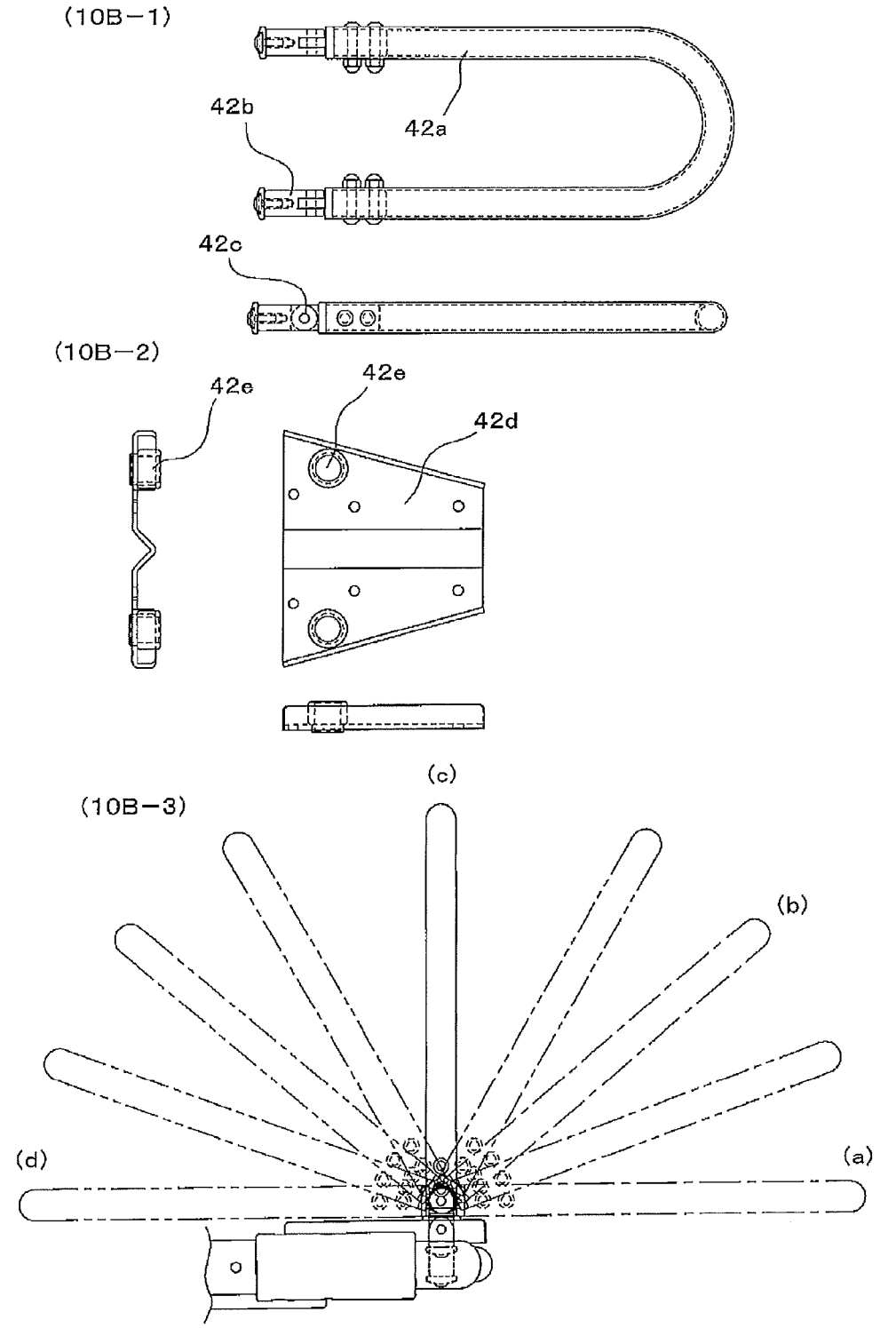
FIG. 10B is a Side views showing components of the handle.

FIG. 10B show components of the handle aim 42 provided at the rear of the upper frame 11 of the stretcher 300. An arm section 42 *a* of the handle arm 42 is U-shaped as shown in FIG. 10B (10B-1) and can be folded at positions of both ends 42 *c* of the arm section 42 *a*. Ends 42 *b* including 42 *c* are inserted into holes 42 *e* of a handle arm attaching part 42 *d* shown in FIG. 10B (10B-2). The holes 42 *e* are slightly deep as shown in a left figure and a bottom figure in FIG. 10B (10B-2). As shown in FIG. 10B (B-3), the handle arm can be fixed at four positions (a), (b), (c) and (d) depending on the insertion state of the holes 42 *e*. At the position (a), the arm section 42 *a* of the handle arm 42 is parallel to the upper frame 11 of the stretcher as shown in FIG. 10A (10A-1). At the position (b), the arm section 42 *a* is inclined with respect to the upper frame 11 of the stretcher by about 45 degrees. At the position (c), the arm section 42 *a* stands vertically. When the ends 42 *b* of the arm section 42 *a* are escaped from the holes 42 *e* and the handle arm is folded at 42 *c*, at the position (d), the handle arm can be folded toward the inner side of the upper frame 11 as shown in FIG. 10A (10A-1) or FIG. 10A (10A-4).

Figure 11A:
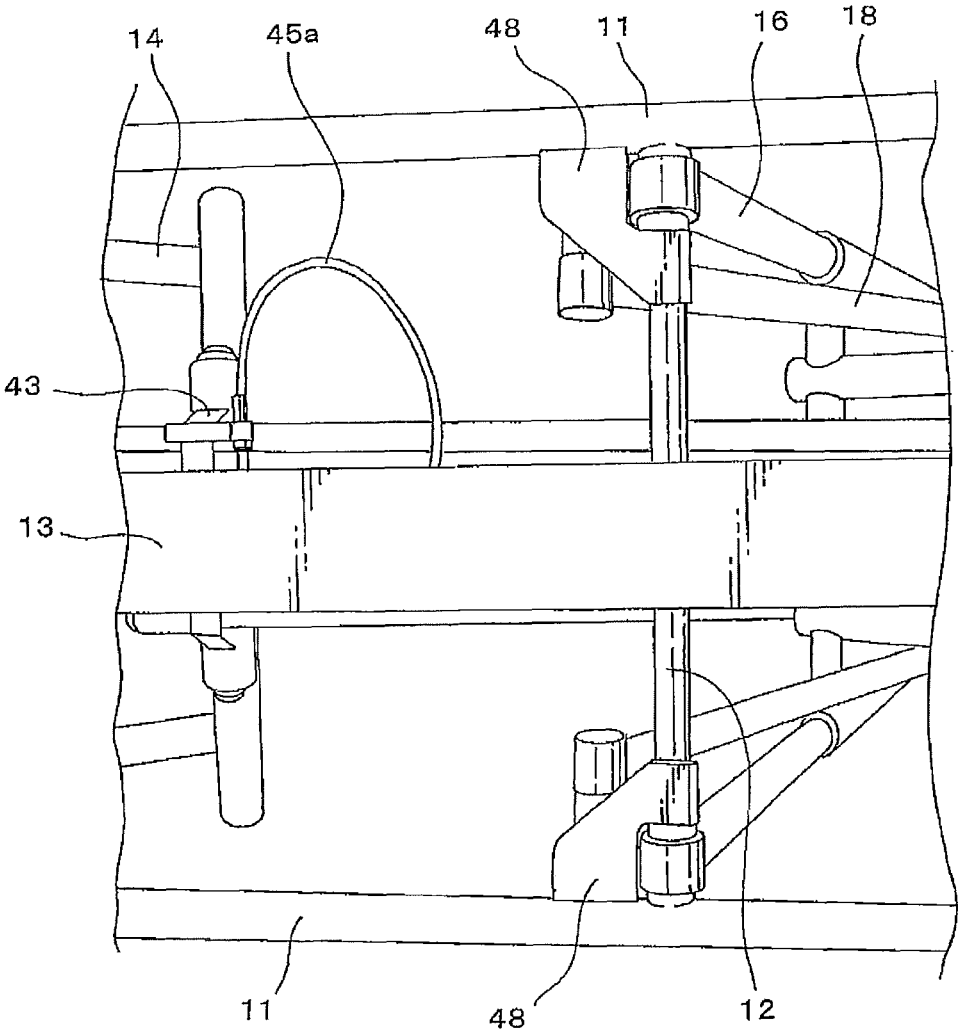
FIG. 11A is a Perspective view showing the case where brackets are provided at corners.

FIG. 11A is a partial perspective view of the rear legs 16 attached to the rectangular upper frame 11. The inside frame 12 is attached to the upper frame 11 and the center rail 13 is provided on the inside frame 12. The pin lock mechanism 43 *ii* of the front legs 14, which is inserted into the front leg frame slide tube 20, is attached to the front legs 14, and the wire 45 *a* coupled to the front lever 44 *a* to operate disconnection of a lock pin 46 of the pin lock mechanism 43 *ii* is connected. When the front legs 14 are expanded by operating the front lever 44 *a*, the wire 45 *a* is pushed and contacts the inside frame 12 to come out of the frame or be caught in the movable parts of the rear legs 16, possibly leading to an accident. Therefore, to prevent the wire 45 *a* from being caught in the other parts, cornered brackets 48 are provided at connection points between the upper frame 11 and the inside frame 12.

Figure 11B:
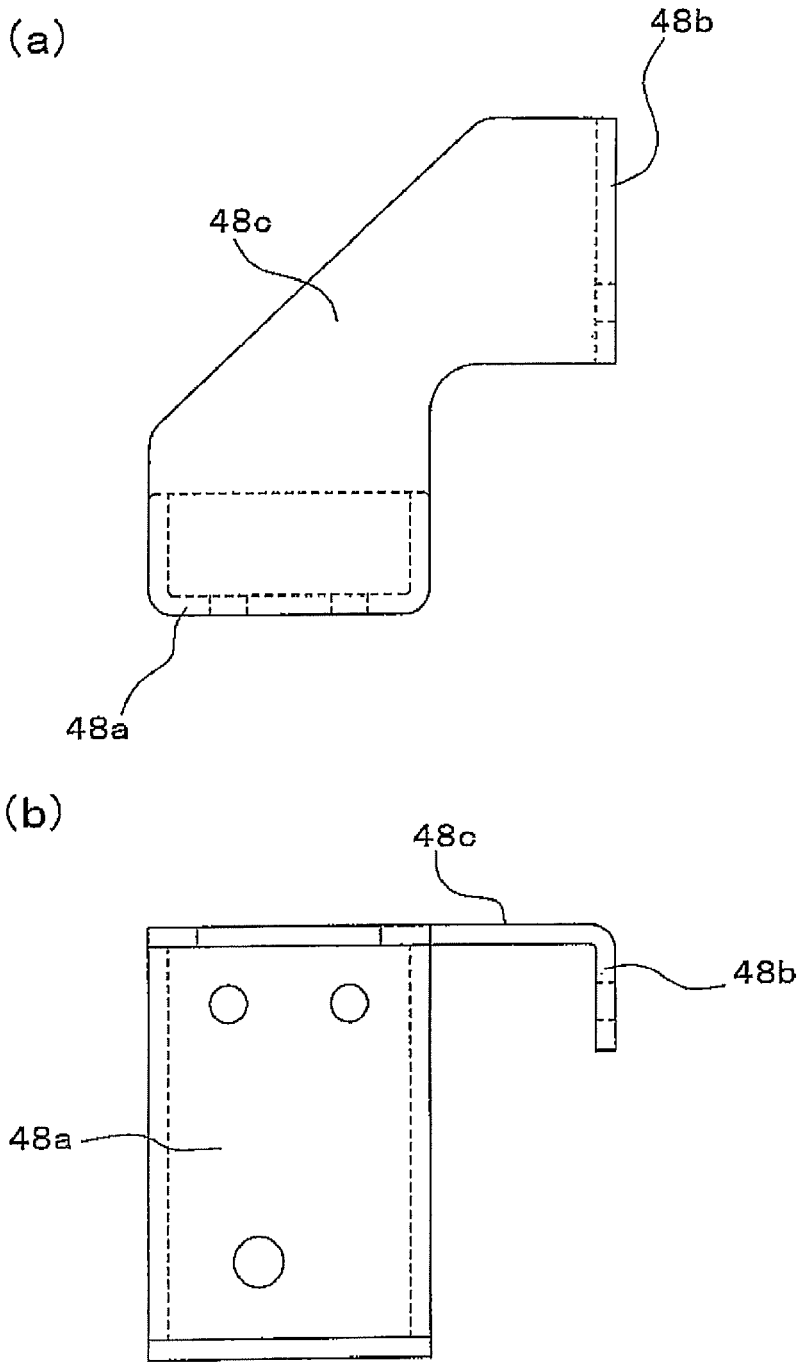
FIG. 11B is a side view of the bracket.

FIG. 11B each show the cornered bracket 48 provided at the connection point between the rectangular upper frame 11 and the inside frame 12. (a) of FIG. 11B is a top view showing the bracket 48. The bracket 48 is composed of a section 48 *a* attached to the upper frame 11 and a section 48 *b* attached to the inside frame 12, a section 48 *c* located inner side of the frames eliminates a right angled section formed at the connection point of the upper frame 11 and the inside frame 12 so as to prevent the wire 45 *a* from being entangled. As shown in (b) of FIG. 11B, the surface 48 *a* fixed to the upper frame 11 of the stretcher and the surface 48 *b* fixed to the inside frame 12 are side surfaces and 48 *c* is an upper surface of the bracket 48.

Figure 12A:
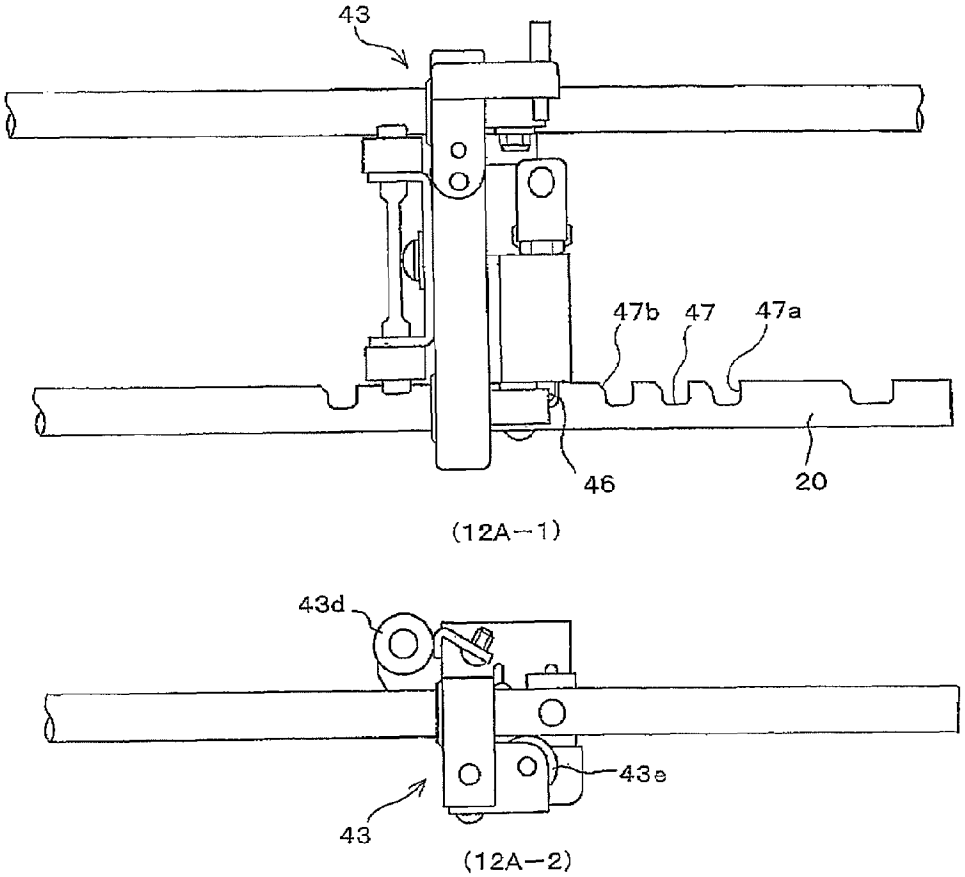
FIG. 12A is a top view and a side view of a slide tube of the stretcher and a pin lock mechanism.

FIG. 12A each show the pin lock mechanism 43 for vertically moving the stretcher 100 (200, 300) and fixing it at a desired position. In this pin lock mechanism 43, the lever 44 *a* (refer to FIG. 9A) at one end of the stretcher 100 is connected to the wire 45 *a* and the lever 44 *b* (refer to FIG. 2) is connected to the wire 45 *b*. When the front and rear levers 44 *a*, 44 *b* are pulled, the wires 45 *a*, 45 *b* are pulled and the respective lock pins 46 are disengaged from the lock grooves 47, resulting in that the stretcher 100 becomes vertically movable. When the front and rear levers 44 *a*, 44 *b* are released at a desirable position, the respective lock pins 46 engage with the lock grooves 47, resulting in that the stretcher 100 is fixed at a desirable position. The lock grooves 47 for receiving and locking the lock pins 46 are made on the front leg slide tube 20 or the rear leg auxiliary frame slide tube 21 (not shown) as shown in FIG. 12A (12A-1). In the lock groove 47 made on the front leg slide tube 20 or the rear leg auxiliary frame slide tube 21 (not shown), a side 47 *a* where loads are applied has a sharp angle so as to sufficiently receive the loads. A side 47 *b* where the lock pin 46 is escaped is tapered so as to allow the lock pin 46 to be easily escaped. When the angle of the side 47 *b* where the lock pin 46 is escaped is increased, the lock pins 46 can engage with the lock groove 47 by merely raising the stretcher without operating the front and rear levers 44 of the stretcher. The lock groove 47 need not be grooves and may be holes engaged with the lock pins 46. The lock grooves engaged with the lock pins 46 are not limited to grooves and may have any shape as long as the lock pins 46 can be easily disengaged and hard to be escaped even when accidental loads are applied.

FIG. 12A (12A-2) shows one side surface of one of the pin lock mechanisms 43 *i*, 43 ii, 43 iii inserted into the front leg slide tube 20 or the rear leg auxiliary frame slide tube 21. For example, a roller 43 *d* of the pin lock mechanism 43 *ii* receives the center rail 13 and a roller 43 *e* receives the front leg slide tube 20 or the rear leg auxiliary frame slide tube 21. By providing the roller 43 *e*, oscillation of the pin lock mechanisms 43 can be relieved.

Figure 12B:
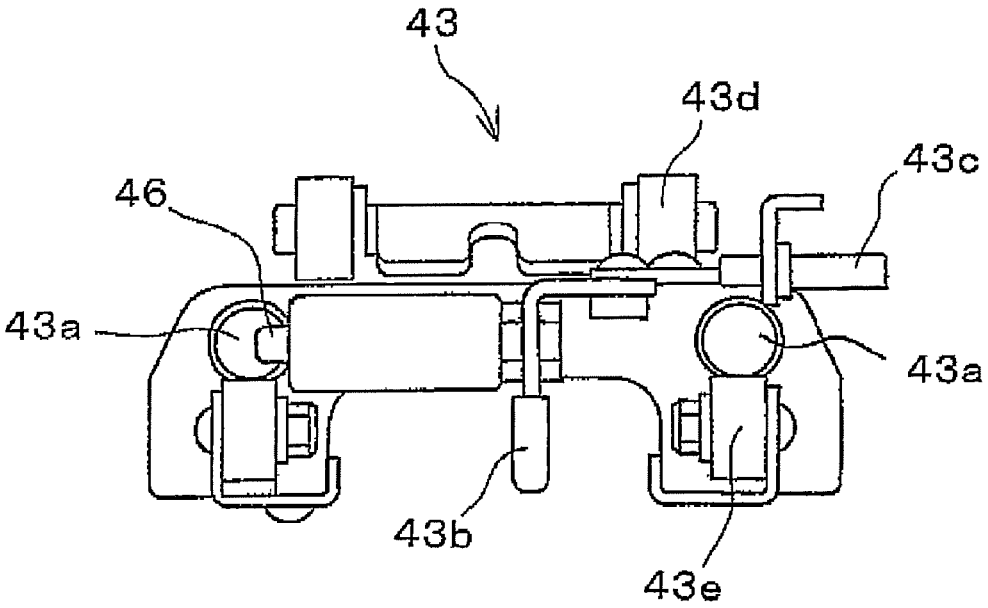
FIG. 12B is a front view showing the pin lock mechanism.

Similarly, describing the pin lock mechanism 43 *i* among the pin lock mechanisms 43 *i*, 43 ii, 43 iii, as shown in FIG. 12B as a front view of the pin lock mechanism 43 *i*, the front leg slide tube 20 is inserted into both holes 43 *a* and the pin lock mechanism 43 *i* of the front legs moves forward and backward. An emergency lever 43 *b* is provided at the center of a lower part of the pin lock mechanism 43 *i* so as to disengage the lock pin 46 in case of emergency. A side wire connecting part 43 *c* is connected to the lever 44 *a* (or lever 44 *b*) attached to the end of the stretcher via the wire 45 *a* (or 45 *b*). The upper roller 43 *d* receives the center rail 13 and the lower roller 43 *e* receives the front leg slide tube 20 to stably hold the pin lock mechanism 43 *i*.

Figure 13A:
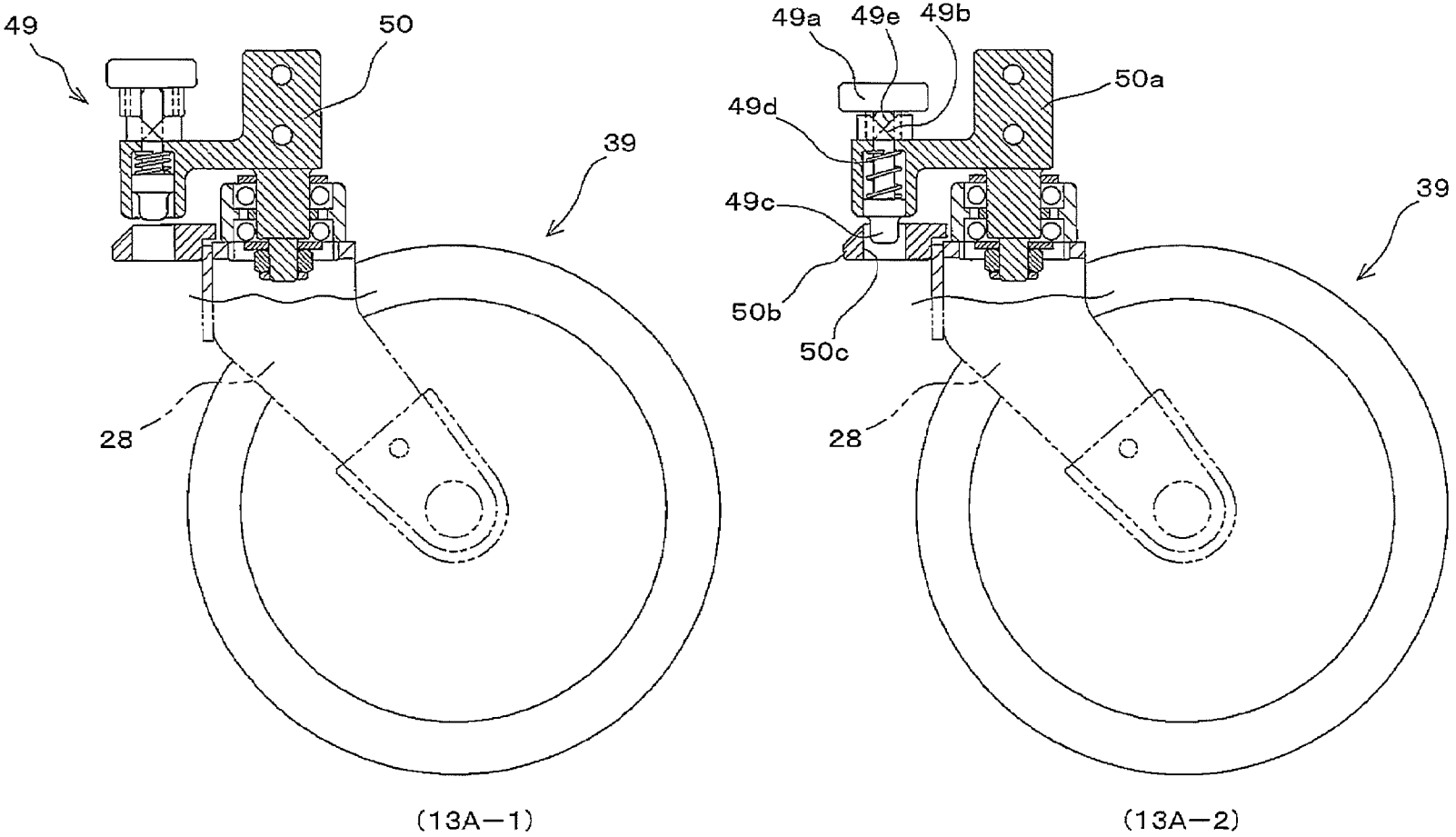
FIG. 13A is a Sectional views showing button-type stoppers for suppressing rotation of the rotatable auxiliary casters.

FIG. 13A each show a cross section of stoppers 49 for suppressing rotation of the rotatable auxiliary casters 39. In order to use the stretcher in a stable state when the stretcher is lowered to bring the auxiliary casters 39 into contact with the ground, the stoppers 49 for suppressing rotation of the rotatable auxiliary casters 39 are provided at the rotatable auxiliary casters 39. A caster shaft 50 *a* is provided above the caster yoke 28 of the rotatable auxiliary caster 39, a stopper pin 49 *c* to which a spring 49 *d* is biased is provided at a front end of the caster shaft 50 *a*, and a fixing part 50 *b* on which a pin hole 50 *c* for receiving the stopper pin 49 *c* is provided under the stopper pin 49 *c* is provided at the front end of the caster yoke 28. The stopper pin 49 *c* has a button 49 *a* for pressing the stopper pin 49 *c* thereon, and is inserted into a pin case 49 *b* with a taper 49 *e* with a bias force of the spring 49 *d*. When the button 49 *a* is rotated to left or right, the stopper pin 49 *c* rises along the taper 49 *e* and escapes from the pin hole 50 *c* as shown in FIG. 13 (13A-1), resulting in that the auxiliary caster 39 becomes rotatable. When the button 49 *a* is rotated to left or right, the stopper pin 49 *c* biased by the spring 49 *d* is inserted into the pin hole 50 *c* and rotation of the rotatable auxiliary caster 39 is suppressed as shown in FIG. 13 (13A-2).

An upper side surfaces of the pin hole 50 *c* of the fixing part 50 *b* attached at the front end of the caster shaft 50 *a* are inclined outward from the pin hole 50 *c*. Even in the state where the stopper pin 49 *c* is pushed down and is not inserted in the pin hole 50 *c*, when the rotatable auxiliary caster 39 is rotated, the stopper pin 49 *c* rises along the inclined side surfaces of the pin hole 50 *c* and the stopper pin 49 *c* is inserted into the pin hole 50 *c*, thereby suppressing rotation of the rotatable auxiliary caster 39.

Figure 13B:
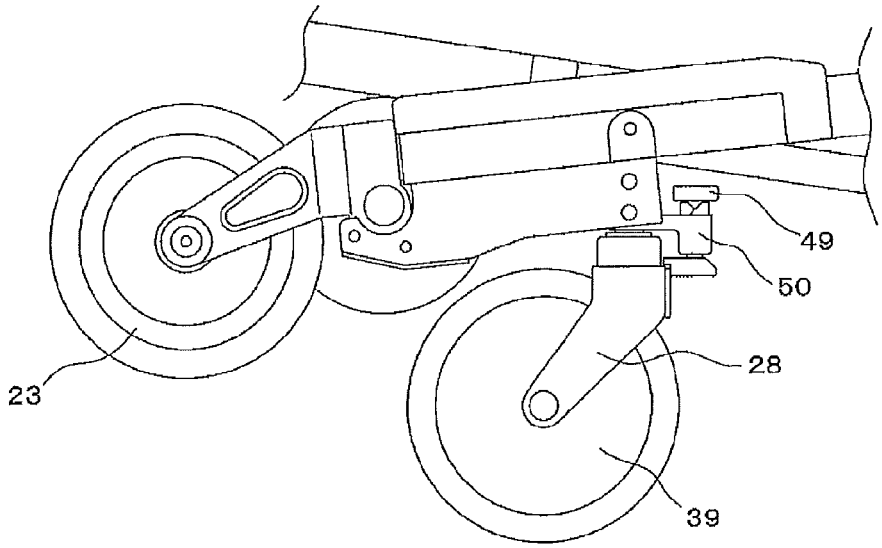
FIG. 13B is a Partial side views showing the rotatable auxiliary casters with the button-type stoppers for suppressing rotation of the auxiliary casters.
Figure 13B:
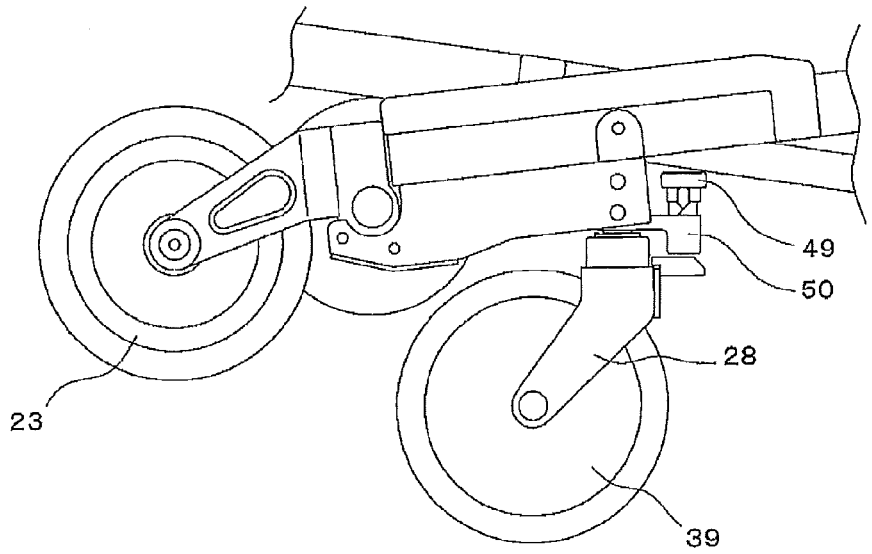

FIG. 13B show a side surface of the auxiliary caster 39 with the stopper 49, which is provided above the front leg fixed caster 23 of the stretcher. FIG. 13B (13B-1) shows the state where the button 49 *a* of the stopper is lowered and rotation of the rotatable auxiliary caster 39 is suppressed. FIG. 13B (13B-2) shows the state where the button 49 *a* of the stopper rises along the tapered surfaces and the stopper 49 is escaped from the pin hole 50 *c*.

Figure 13C:
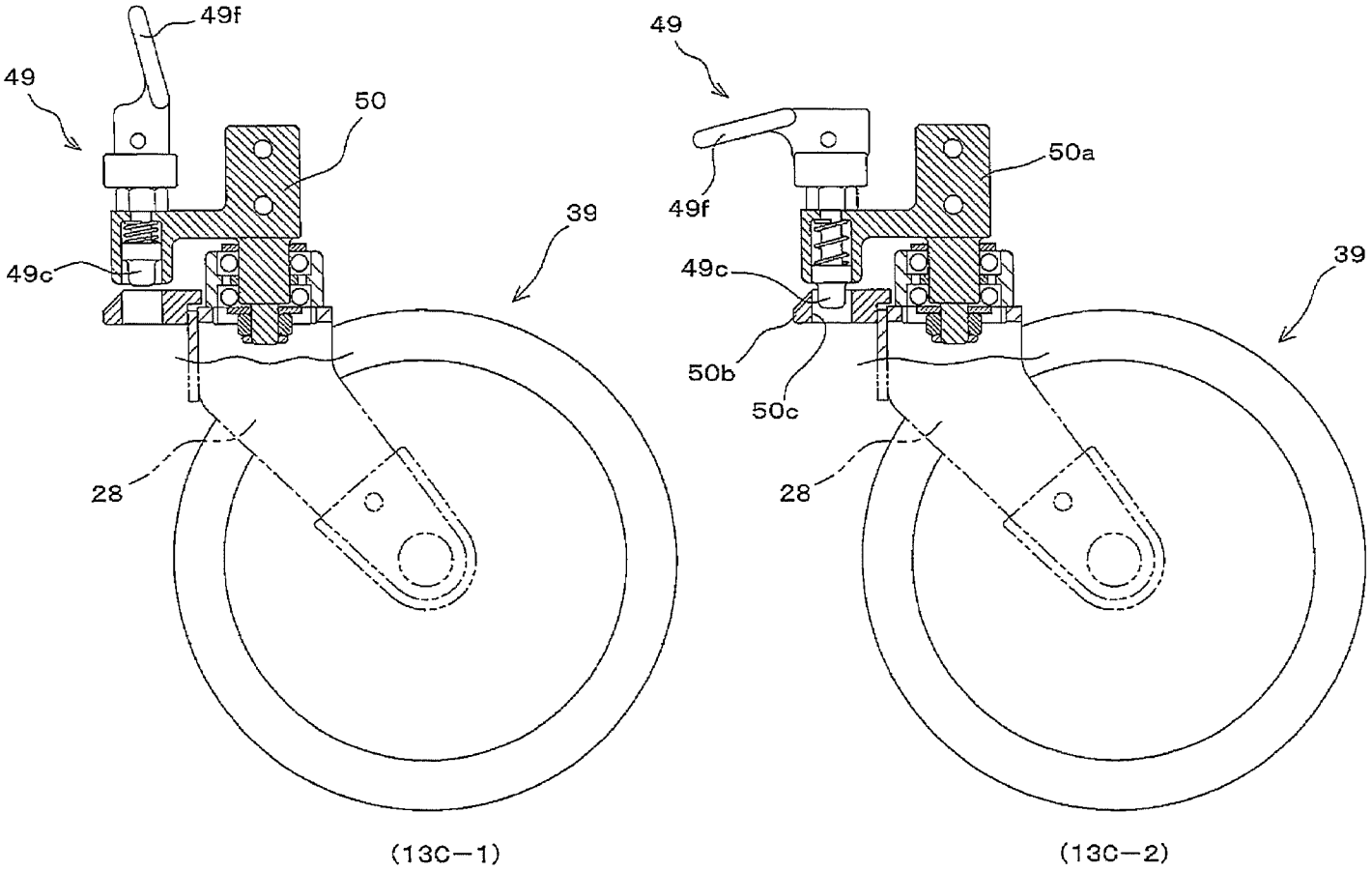
FIG. 13C is a Sectional views showing flip-up-type stoppers for suppressing rotation of the rotatable auxiliary casters.

FIG. 13C each show an example in which flip-up levers 49 *f* for suppressing rotation of the rotatable auxiliary casters are provided in place of the button-type stoppers 49 for suppressing rotation of the rotatable auxiliary casters. In FIG. 13C (13C-1), in place of the button 49 *a* of the stopper for suppressing rotation of the rotatable auxiliary caster, the lever 49 *f* is provided at the top of the stopper 49. By vertically moving the lever 49 *f* provided at the top of the stopper 49, thereby pulling the stopper pin 49 *c* out of the pin hole 50 *c*, it is possible to suppress rotation of the rotatable auxiliary caster or make the rotatable auxiliary caster rotatable. FIG. 13C (13C-2) shows the state where the lever 49 *f* is risen and the stopper pin 49 *c* is pulled out of the pin hole 50 *c* so as to make the rotatable auxiliary caster rotatable, from the state where rotation of the rotatable auxiliary caster is suppressed.

Figure 14:
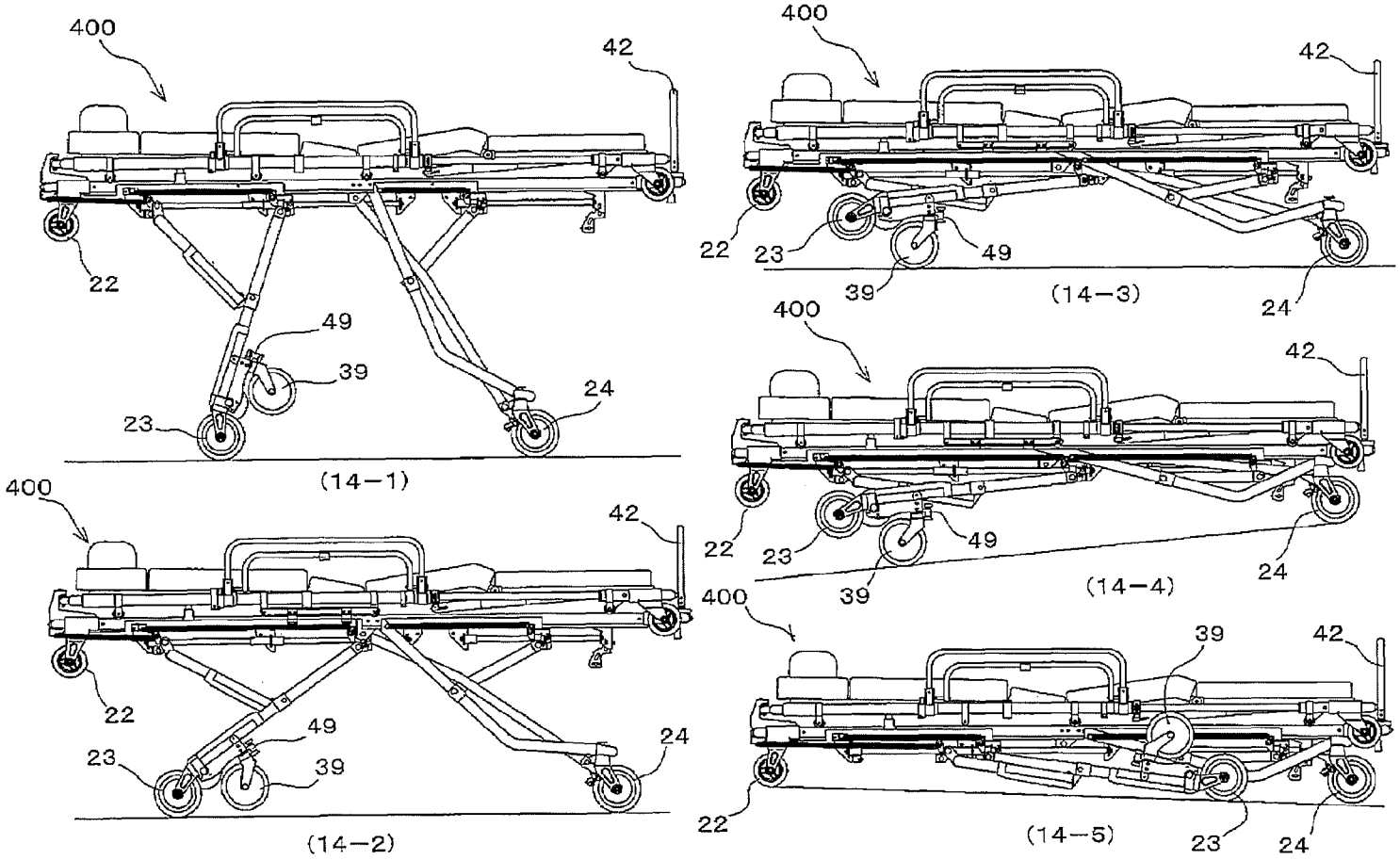
FIG. 14 is a Side views showing the six-wheeled stretcher with the auxiliary caster having the stoppers for suppressing rotation of the auxiliary casters.

FIG. 14 are side views of the six-wheeled stretcher 400 with the rotatable auxiliary casters 39 having the stoppers 49 in different heights. In FIG. 14, although the spring members are provided as the slide mechanisms for assisting vertical movement of the stretcher 400, the slide mechanisms are not limited to the spring members and the constant force springs may be used as the slide mechanisms.

FIG. 14 (14-1) shows the six-wheeled stretcher 400 according to the present invention at the highest position. When the stretcher is brought down from the ambulance car, the stretcher is generally put into this state. FIG. 14 (14-2) shows the six-wheeled stretcher 400 according to the present invention at the intermediate position. At this position, the six-wheeled stretcher 400 is supported by the front leg fixed casters 23 and the rotatable casters 24 of the rear legs. When, for example, the patient is transferred from the bed at a high position, the stretcher is adjusted and fixed to this height. FIG. 14 (14-3) shows the six-wheeled stretcher 400 according to the present invention at the low position (about 550 mm). At this position, the rotatable auxiliary casters 39 provided above the front leg fixed casters 23 and the rotatable casters 24 of the rear legs contact the ground. Since the front and rear casters 39, 24 are rotatable in this state, the auxiliary casters 39 can be fixed by the stoppers 49 for suppressing rotation of the front auxiliary casters 39. The patient can be transferred at the low position and transported in this state with the handle arm 42 and the like. Further, emergency treatment such as cardiac massage can be made to the patient received on the stretcher. By transporting the stretcher 400 in a state where the stoppers 49 for suppressing rotation of the front auxiliary casters 39 are applied, the auxiliary casters 39 do not rotate even when the auxiliary casters 39 contact with obstacles such as small stones on the road surface, and therefore, workloads exerted on the ambulance crew who transports the stretcher 400 can be reduced.

FIG. 14 (14-4) shows six-wheeled stretcher 400 according to the present invention in the lowest stage. When the patient located at the low position such as on the ground is received on the stretcher, the stretcher is adjusted to this position. FIG. 14 (14-5) shows the shape of the six-wheeled stretcher 400 according to the present invention that is mounted in the ambulance car. The front section of the stretcher 400 is supported by the fixed caster 22 and the rear section of the stretcher 400 is supported by the front leg fixed casters 23 and the rear rotatable casters 24.

What is claimed is:

1. A stretcher, comprising:

an upper frame for mounting a lifter thereon;

a front leg pivotably attached to the upper frame;

a rear leg pivotably attached to the upper frame;

a fixed caster attached to one end of the front leg;

a swivel caster attached to one end of the rear leg;

an auxiliary swivel caster attached to the front leg; and a brake assembly for applying braking force to the swivel caster;

wherein the front leg and rear leg are arranged to move in the same direction and in opposite directions and the brake assembly is arranged to apply braking force to the swivel caster when the stretcher is fully lowered and the front and rear legs are arranged in the same direction or opposite directions;

wherein the upper frame is vertically adjustable by folding the front and rear legs relative to the upper frame;

wherein the auxiliary swivel caster is positioned relative to the fixed caster such that the auxiliary swivel caster is in contact with the ground when the upper frame is fully lowered and the front leg is folded away from the rear leg, and the auxiliary swivel caster is out of contact with the ground when the upper frame is fully lowered and the front leg is folded toward the rear leg;

wherein the brake assembly includes a spring-biased button that is depressed by engaging with the upper frame to actuate the brake when the upper frame is fully lowered, and is released from contact with the upper frame when the upper frame is raised to disengage the brake; and wherein a stopper is arranged to cooperatively engage the frame when in the lowered position to control swiveling movement of the auxiliary swivel caster.

2. The stretcher according to claim 1, wherein the front and rear legs are independently pivotable relative to the upper frame such that the upper frame can achieve a horizontal position on an angled ground surface.

3. The stretcher according to claim 1, wherein both the fixed caster and the auxiliary swivel caster are in contact with the ground when the upper frame is at an intermediate vertical position.

4. The stretcher according to claim 1, wherein an upper end of the front leg circumferentially surrounds and engages a tubular member of the upper frame and is horizontally slidable along the tubular member of the upper frame.

5. The stretcher according to claim 1, wherein the vertical height of the stretcher when fully lowered in from 300 mm to 700 mm above the ground.

6. A stretcher, comprising:

an upper frame supporting a lifter;

a slide mechanism including a slide tube mounted to the upper frame for driving vertical movement of the upper frame;

a front leg having an upper end slidably and pivotably attached to the slide tube and having a lower end with a fixed caster attached thereto;

a rear leg assembly including a rear leg and a rear auxiliary leg each pivotably attached to the upper frame;

a swivel caster attached to a lower end of the rear leg through a pivoting link; a support arm attached to the rear auxiliary leg and the pivoting link;

an auxiliary swivel caster mounted to the front leg above the fixed caster; and a brake assembly for applying braking force to the swivel caster, wherein:

the front leg and rear leg are arranged to move in the same direction and in opposite directions and the brake assembly is arranged to apply braking force to the swivel caster when the stretcher is fully lowered and the front and rear legs are arranged in the same direction or opposite directions; wherein:

wherein the brake assembly includes a spring-biased button that is depressed by engaging with the upper frame to actuate the brake when the upper frame is fully lowered, and is released from contact with the upper frame when the upper frame is raised to disengage the brake; and wherein a stopper is arranged to cooperatively engage the frame when in the lowered position to control swiveling movement of the auxiliary swivel caster.

7. The stretcher according to claim 6, wherein the vertical height of the stretcher when fully lowered in from 300 mm to 700 mm above the ground.

8. A stretcher, comprising:

a frame for mounting a lifter thereon;

front and rear leg assemblies cooperatively supporting the frame and configured to pivot relative to the frame to change the vertical position of the frame relative to the ground, the front leg assembly including a front leg horizontally slidable along the frame and the rear leg assembly including a rear leg pivotably attached to the frame;

a fixed caster attached to one end of the front leg;

a swivel caster attached to one end of the rear leg;

an auxiliary swivel caster attached to the front leg and positioned relative to the fixed caster such that, with regard to the fixed caster and the auxiliary swivel caster, only the fixed caster is in contact with the ground when the frame is fully raised, only the fixed caster is in contact with the ground when the frame is fully lowered and the front leg is folded toward the rear leg, and only the auxiliary swivel caster is in contact with the ground when the frame is fully lowered and the front leg is folded away from the rear leg; and a brake assembly for applying braking force to the swivel caster;

wherein the front leg and rear leg are arranged to move in the same direction and in opposite directions and the brake assembly is arranged to apply braking force to the swivel caster when the stretcher is fully lowered and the front and rear legs are arranged in the same direction or opposite directions;

wherein the brake assembly includes a spring-biased button that is depressed by engaging with the upper frame to actuate the brake when the upper frame is fully lowered, and is released from contact with the upper frame when the upper frame is raised to disengage the brake; and wherein a stopper is arranged to cooperatively engage the frame when in the lowered position to control swiveling movement of the auxiliary swivel caster.

9. The stretcher according to claim 8, wherein the front and rear legs are independently pivotable relative to the upper frame.

10. The stretcher according to claim 8, wherein both the fixed caster and the auxiliary swivel caster are in contact with the ground when the upper frame is at an intermediate vertical position.

11. The stretcher according to claim 8, wherein an upper end of the front leg is pivotably and slidably attached to a tubular member of the upper frame.

12. The stretcher according to claim 8, wherein the vertical height of the stretcher when fully lowered in from 300 mm to 700 mm above the ground.

* * * * *

UNITED STATES PATENT AND TRADEMARK OFFICE

CERTIFICATE OF CORRECTION

PATENT NO. : 9,021,634 B2
APPLICATION NO. : 14/136279
DATED : May 5, 2015
INVENTOR(S) : Kazuyuki Goto, Noriyuki Matunaga and Shigeyuki Matunaga It is certified that error appears in the above-identified patent and that said Letters Patent is hereby corrected as shown below:

On the title page, item (73) the Assignee's city should read: Yoro-Gun

Signed and Sealed this
Twenty-third Day of February, 2016

Michelle K. Lee

Michelle K. Lee
*Director of the United States Patent and Trademark Office*